US006156489A

United States Patent [19]

Iwasaki et al.

[11] Patent Number: 6,156,489

[45] Date of Patent: Dec. 5, 2000

[54] SILVER HALIDE PHOTOSENSITIVE MATERIAL

[75] Inventors: Toshihiko Iwasaki; Masaru Iwagaki, both of Tokyo, Japan

[73] Assignee: Konica Corporation, Japan

[21] Appl. No.: 09/091,258

[22] PCT Filed: Oct. 9, 1997

[86] PCT No.: PCT/JP97/03629

§ 371 Date: Jun. 9, 1998

§ 102(e) Date: Jun. 9, 1998

[87] PCT Pub. No.: WO98/15874

PCT Pub. Date: Apr. 16, 1998

[30] Foreign Application Priority Data

Oct. 9, 1996 [JP] Japan ..... 8-268645
Oct. 15, 1996 [JP] Japan ..... 8-272341

[51] Int. Cl.[7] ..... G03C 7/30; G03C 7/32

[52] U.S. Cl. ..... 430/505; 430/503; 430/549; 430/552; 430/556; 430/557

[58] Field of Search ..... 430/503, 549, 430/556, 557, 552, 505

[56] References Cited

U.S. PATENT DOCUMENTS 5,362,616 11/1994 Edwards et al. ..... 430/356

*Primary Examiner*—Janet Baxter
*Assistant Examiner*—Amanda C. Walke
*Attorney, Agent, or Firm*—Jordan B. Bierman Bierman, Muserlian and Lucas

[57] ABSTRACT

A silver halide photographic light sensitive material comprising a transparent support and provided thereon a light sensitive layer containing a yellow coupler, a magenta coupler and a cyan coupler to form a monochromatic image upon color development after exposure, wherein a relative coupling rate of the magenta coupler with an oxidation product of a color developing agent is higher than that of the yellow or cyan coupler.

12 Claims, 4 Drawing Sheets

SILVER HALIDE PHOTOSENSITIVE MATERIAL

FIELD OF THE INVENTION

The present invention relates to a silver halide photographic light sensitive material forming a monochromatic image, and in particular, to a silver halide photographic light sensitive material (hereinafter, referred to as a photographic material) for use in picture-taking, which is color developable.

BACKGROUND OF THE INVENTION

Currently, there has been widely spread a photographic system in which a color photographic material for picture-taking (color negative film) is loaded into a camera, exposed, developed, and the developed color negative is printed on color print paper to obtain a color positive image (negative-positive system).

On the other hand, a reversal-type color photographic material for picture-taking (color reversal film), after exposed, is subjected only to reversal development to obtain a positive image, having advantages that the developed film is observed as it is or through a slide projector, or is printed to produce a positive color print (positive-positive system). However, the reversal photographic material is not as popular as the negative-positive system described above, because the photographic material is not suited for easy photographing because of narrow photographic latitude, and positive color prints are rather expensive.

Recently, there appeared in the market a prepackaged photographic unit, so-called lens-fitted film in which unexposed color negative film is packaged in the state ready for immediate exposure, leading to an increase of picture-taking opptunities to further promote the negative-positive system.

Along with the spread of the color photographic system, recently, black-and-white (or monochromatic) photographic camera material caused a small boom. This was contemplated to be due to the fact that black-and-white (or monochromatic) images are freshly appreciated and its unique portrayal is considered mysterious, compared to the common flooded color photographs.

The main users of conventional monochromatic photographic camera materials were primarily professionals and advanced amateurs. However, since "Torikkiri Konica Shirokuro" (Film-In-Mini Konica Black-and-White) was put on the market in April, 1995, everybody was allowed to enjoy basic photography using monochromatic photographic materials. As a result, the photographic industry could not help but direct its attention to be directed to this unexpectedly popular medium.

Silver image forming-type monochromatic photographic camera materials are entirely different in photographic processing from color photographic system of negative-positive process, producing problems such that troublesome selection and handling of monochromatic photographic materials was needed in the commercial processing facilities and a separate processing line for monochromatic photographic materials had to be installed.

There are known monochromatic photographic camera materials which are compatible with broadly popularized color photographic processing of the negative-positive system; for example, a monochromatic image forming photographic material by the use of a black coupler, as disclosed in U.S. Pat. Nos. 2,592,514 and 4,348,474; JP-B 63-59136 (herein, the term "JP-B" refers to examined and published Japanese Patent). U.S. Pat. Nos. 2,181,944, 2,186,736, 4,368,255 and 5,141,844; JP-A-57-56838, 57-5814758-215645, 3-107144, 6-214357 and 7-199421; and JP-A 6-505580 also disclose a technique of forming monochromatic dye image by using a mixture of yellow, magenta and cyan couplers.

Although processed in common with conventional processing, any of these had the problem that printing on print paper was troublesome. When the above-described technique is applied to conventional color development, either one of color forming components destroys, due to difference in reactivity of the couplers, the balance with other components. As a result, it becomes difficult to obtain neutral gray color in the overall density range or processing variation due to the concentration of a developing agent, pH, temperature or contamination (carrying-in of undesired material), making it difficult to stably form monochromatic images. Preferred as monochromatic prints in final image, are warm color tone, warm, nostalgic sepia color tone, therefore, easy making of these sepia-toned monochromatic prints is desired.

Further, even if monochromatic images can be formed in color negative development by combination with color print paper, and unless monochromatic paper printing suitability is provided, it is very difficult to respond to broad consumer needs.

In the case of forming monochromatic images with dyes, all of the couplers react in a high exposure region to cause nongranularity, leading to superior graininess in the high density region, as compared to a silver image. However, graininess in a low exposure region, on the contrary, is deteriorated, so that it is necessary to enhance graininess of monochromatic dye images in the low exposure region. Since the human eye is very sensitive to even slight color shift from neutral monotone, it is further necessary to design so as to produce a smooth tone, taking account of dependence of development and balance of developability with respect to high-sensitive, medium-sensitive and low-sensitive layers.

SUMMARY OF THE INVENTION

Accordingly, it is an object of the present invention to provide a monochromatic image forming silver halide photographic light sensitive material for picture-taking use, which is suited for color photographic processing of the negative-positive system, is superior in graininess, is easy to print on color or black-and-white paper and is capable of easily producing a sepia-toned black-and-white print.

The object of the present invention was accomplished by the following:

(1) a silver halide photographic light sensitive material comprising a transparent support and provided thereon a light sensitive layer containing a yellow coupler, a magenta coupler and a cyan coupler to form a monochromatic image upon color development after exposure, wherein a relative rate of coupling of the magenta coupler with an oxidation product of a color developing agent is higher than that of the yellow or cyan coupler;

(2) the silver halide photographic material described in (1), wherein the relative coupling rate of the yellow, magenta or cyan coupler is defined in term of the following CRR value, the CRR value of the magenta coupler being less than that of the yellow or cyan coupler, $$CRR=(Do)_{max}/(Dc)_{max}$$

wherein $(Do)_{max}$ represents a maximum density obtained when a photographic material sample that contains indivisually the yellow, magenta or cyan coupler is subjected to exposure and color development in a developing solution, and $(Dc)_{max}$ represents a maximum density obtained when the photographic material sample is subjected to exposure and development in the developing solution that further contains citrazinic acid of 1.5 g/l;

(3) the silver halide photographic material described in (1) or (2), wherein a CRR value of the magenta coupler (CRR-M), that of the yellow coupler (CRR-Y) and that of the cyan coupler (CRR-C) satisfy the following relationship, $$0.8<\text{CRR-M}/\text{CRR-Y}<1.0$$

$$0.8<\text{CRR-M}/\text{CRR-C}<1.0;$$

(4) the silver halide photographic material described in (1), (2) or (3), wherein the yellow, magenta and cyan couplers are represented by the following formulas (1), (2) and (3), respectively, formula (1)

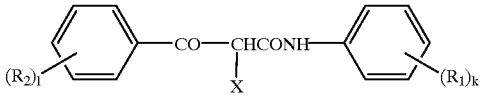

wherein $R_1$ and $R_2$ each represent a hydrogen atom or a substituent, k and l each represent an integer of 1 to 5, provided that when k or l is 2 or more, plural $R_1$s or plural $R_2$s may be the same with or different from each other and X represents a group capable of being released upon coupling with an oxidation product of an aromatic primary amine color developing agent, formula (2)

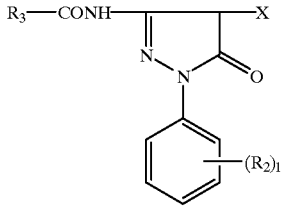

wherein $R_3$ represents a substituent, $R_2$ and l each are the same as defined in formula (1), provided that when l is 2 or more, plural $R_2$s may be the same with or different from each other, and X represents a group as defined in formula (1), provided that the group is bonded, through a nitrogen atom, to the 4-position of a pyrazolone ring, formula (3)

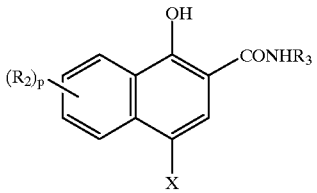

wherein $R_2$ and $R_3$ are the same as defined in formula (2), p represents an integer of 1 to 4, provided that when p is 2 or more, plural $R_2$s may be the same with or different from each other, and X is a hydrogen atom or the same as defined in formula (1);

(5) the silver halide photographic material described in (1), (2) or (3), wherein the yellow and cyan couplers are those represented by formula (1) and (3), respectively, and the cyan coupler is a polymer coupler obtained by polymerizing a monomer represented by the following formula (4), formula (4)

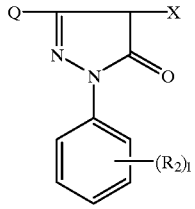

wherein $R_2$ and l are the same as defined in formula (2), provided that when l is 2 or more, $R_2$ may be the same with or different from each other, X is the same as defined in formula (1) and Q represents a substituent having an ethylenic unsaturated double bond;

(6) the silver halide photographic material described in (1), (2) or (3), wherein the yellow, magenta and cyan couplers are those represented by the following formulas (5), (6) and (7), respectively, formula (5)

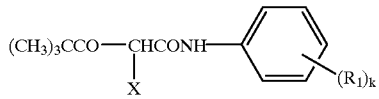

wherein $R_1$ represents a hydrogen atom or a substituent, k represents an integer of 1 to 5, provided that when k is 2 or more, $R_1$ may be the same with or different from each other, and X is the same as defined in formula (1), formula (6)

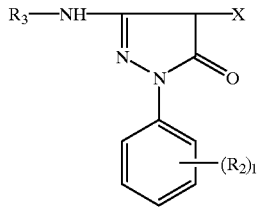

wherein $R_3$ represents a substituent, R2 and l are the same as defined in formula (1), provided that when l is 2 or more, $R_2$ may be the same with or different from each other, and X is the same group as defined in formula (1), provided that the group is bonded, through a sulfur atom, to the 4-position of a pyrazolone ring, formlula (7)

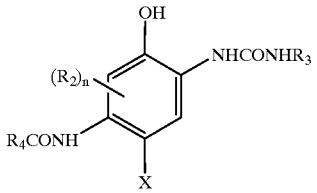

wherein $R_2$ and $R_3$ are the same as defined in formula (2), $R_4$ represents a substituent, n represents an integer of 1 or 2, provided that when n is 2, $R_2$ may be the same with or different from each other, and X is a hydrogen atom or the same group as defined in formula (1);

(7) the silver halide photographic material described in any one of (1) through (6), wherein all of the couplers described above are two-equivalent couplers;

(8) the silver halide photographic material described in any one of (1) through (7), wherein the light sensitive layer comprises at least two light sensitive sublayers each containing the couplers described above and the sublayers having the same spectral sensitivity;

(9) the silver halide photographic material described in (1), (2) or (3), wherein the light sensitive layer comprises a high-speed light sensitive sublayer, a medium-speed light sensitive sublayer and a low-speed light sensitive sublayer, which are the same in spectral sensitivity and different in speed; the low-speed sublayer containing dye image forming couplers in an amount that gives a density of not less than 40% of the maximum density of the photographic material developed;

(10) the silver halide photographic material described in (1), (2) or (3), wherein the light sensitive layer further contains a DIR compound, the photographic material further comprising a UV-absorbing light-insensitive layer provided farther from the support than the light sensitive layer and having a transmission density at a wavelength of 370 nm of 1.0 to 2.0 in a minimum density portion;

(11) the silver halide photographic material described in (1), (2) or (3), wherein the light sensitive layer comprises a high-speed light sensitive sublayer, a medium-speed light sensitive sublayer and a low-speed light sensitive sublayer, which are the same in spectral sensitivity and different in speed, the high-speed, medium-speed and low-speed sublayers each containing a DIR compound and a molar content of the DIR compound of the low-speed sublayer being larger than that of the high-speed or medium-speed sublayer;

(12) the silver halide photographic material described in any one of (1) through (11), wherein the light sensitive layer contains a colored coupler;

(13) the silver halide photographic material described in any one of (1) through (12), wherein the photographic material is a negative film used in negative-positive process in which a negative image is printed on a color paper or a monochromatic paper to form a positive print image with a mono-color tone;

(14) a photographing unit, wherein the silver halide photographic material described in (1) through (13) is loaded and packaged in the state capable of being photographed; and

(15) a method for forming a monochromatic image by exposing the silver halide photographic material described in any one of (!) through (13) and developing the exposed photographic material with a color developing solution.

NUMERALS

Figure 1:
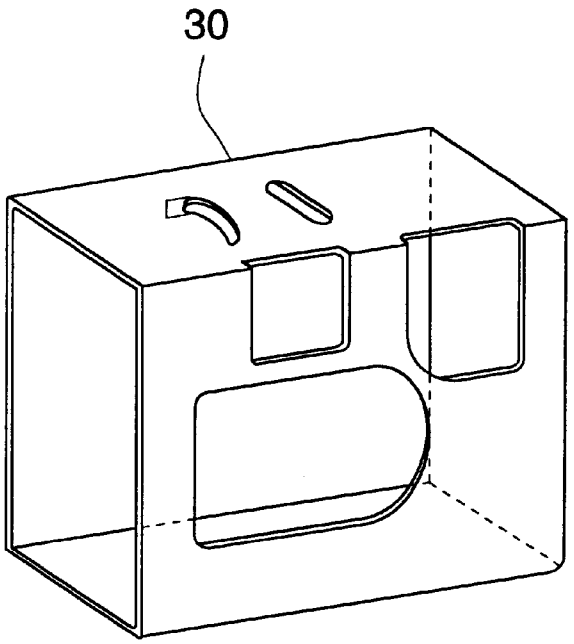
FIG. 1 is perspective view of a photographing unit.
Figure 1:
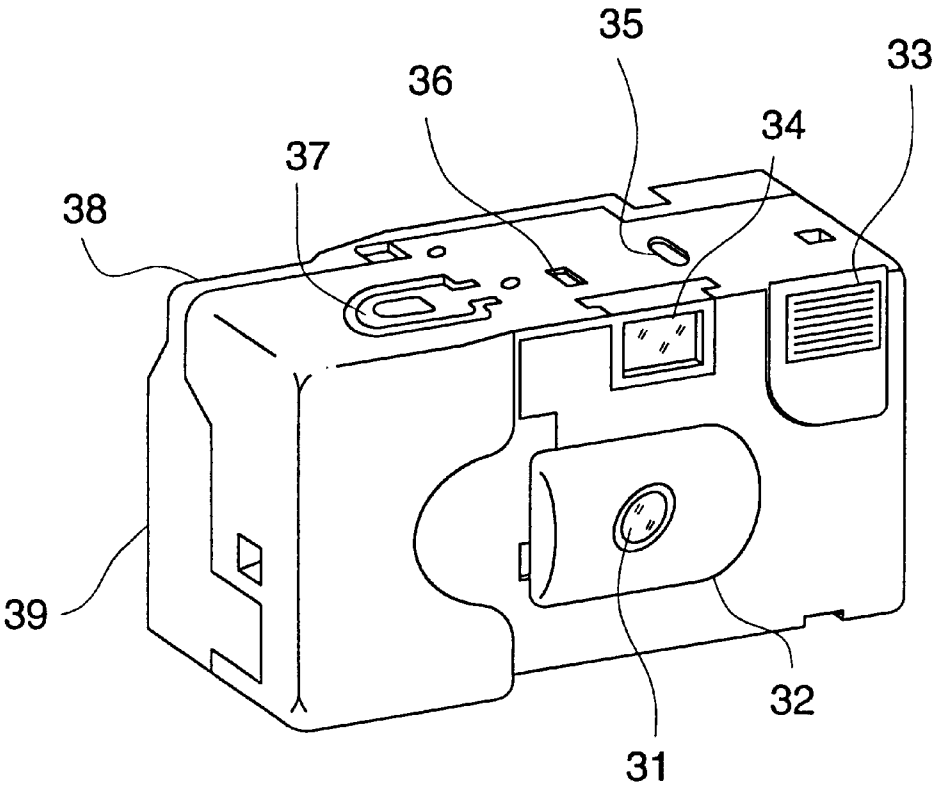
Figure 2:
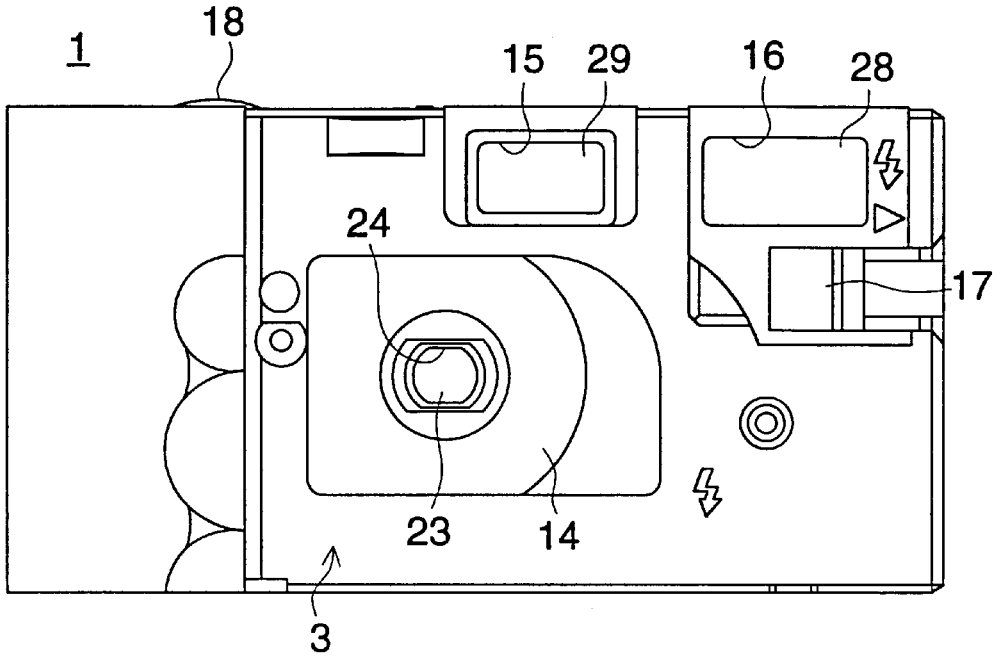
FIG. 2 is front view of a singlr use camera before being with a paper cover.
Figure 3:
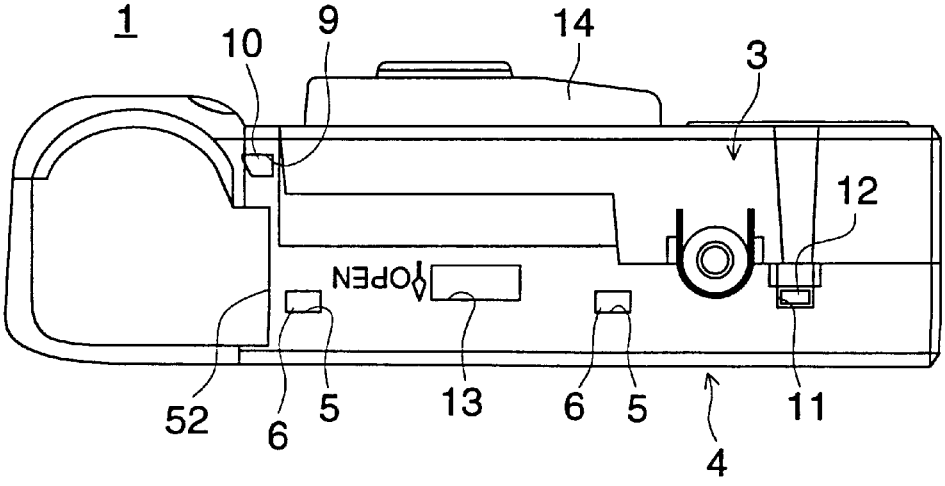
FIG. 3 is bottom view of a singlr use camera before being provided with a paper cover.
Figure 4:
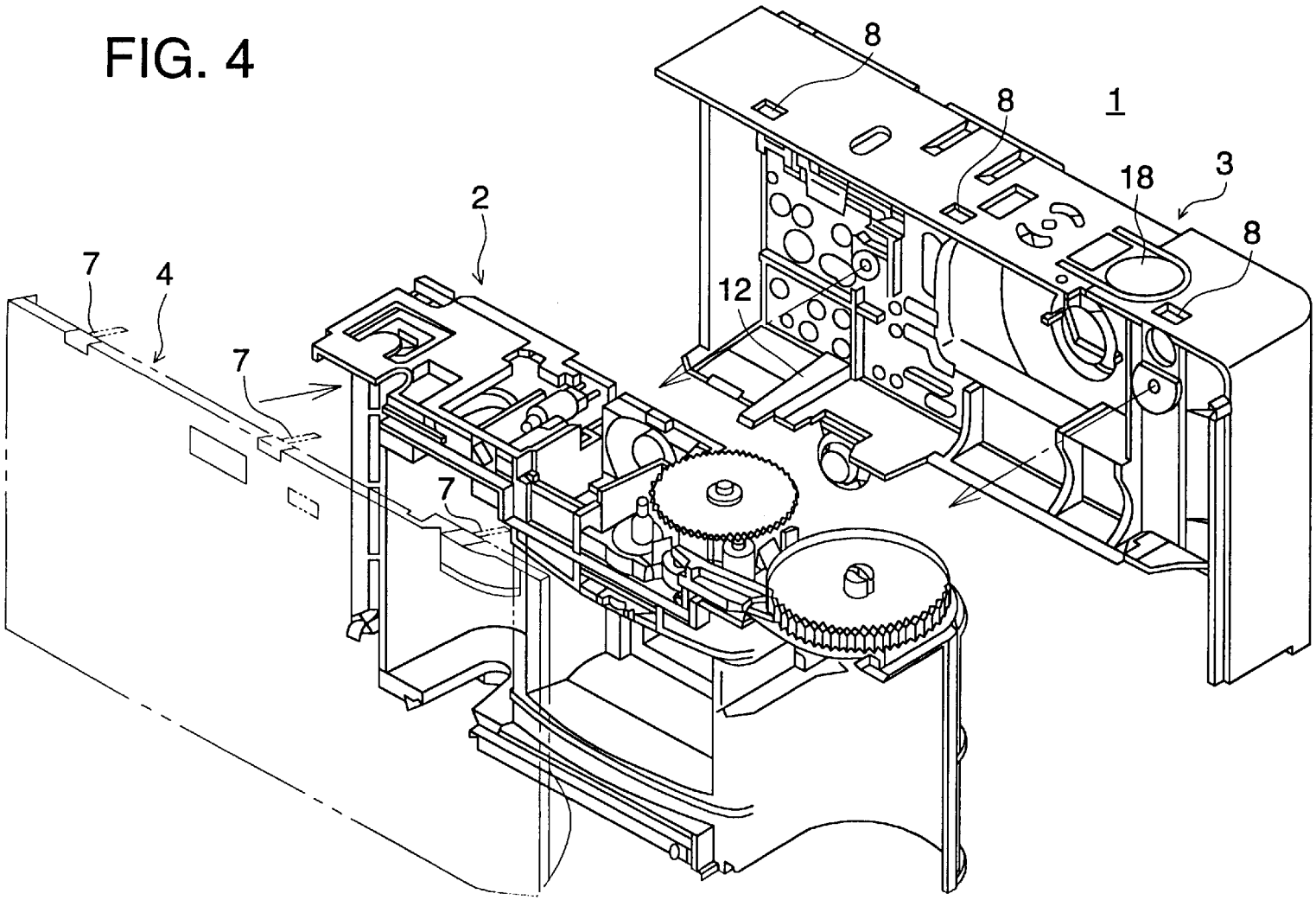
FIG. 4 is exploded perspective view of a camera body, front cover and a back cover.

1 singlr use camera
2 Camera body
3 Front cover
4 Back cover
5 Engaging hole formed on the lower side of back cover 4
6 Engaging protrusion formed on the lower side of camera body
7 Engaging hook formed on the upper side of back cover 4
8 Engaging hole formed on the lower side of back cover 4
11 Engaging protrusion constituting engaging concave formed on the lower side of back cover 4
12 Engaging hook formed on the lower side of front cover 3
14 Convex portion
15 Finder window
16 Flash window
18 Release button
23 Photographing lens
24 Lens window formed in front cover
28 Flash emitting portion
29 Finder objective lens
30 Carton
31 Lens for photographing
32 Lens mount
33 Stroboscope emitter
34 Finder
35 Pilot lamp of stroboscope charge
36 Film counter window
37 Release button
38 Film winding knob
39 Rear cover
50 Paper cover
51 Notched die-cut line
52 Concave to be put into the edge of paper cover 50

DETAILED DESCRIPTION OF THE INVENTION

In the present invention, the expression "monochromatic" means single color or single color tone, and it is not always to be black-and-white or one comprised of developed silver alone. Accordingly, for example, a monochromatic image means an image substantially having a single color or single color tone.

The relative coupling rate of each of the couplers is determined in the CRR value as defined below. Thus, a photographic material sample which is prepared through indivisually dispersing the couplers and adding the resulting dispersion into a silver halide emulsion, is exposed and developed in a developing solution. In this case, the maximum density of the developed sample is denoted as $(Do)_{max}$. The photographic material sample is also exposed and developed with the same developing solution as above, except that citrazinic acid of 1.5 g/l is further added to the developing solution. The maximum density of the developed sample is denoted as $(Dc)_{max}$. The coupling rate of the coupler can be relatively evaluated, based on the following equation:

$$CRR=(Do)_{max}/(Dc)_{max}.$$

In other words, the CRR value is not less than 1.0 and the closer to 1.0, the higher the coupling rate. In cases where plurality of the same color type couplers are used in combination, the CRR value of a coupler having the highest coupling rate among the couplers is applied.

In general, phenol type cyan couplers having an ureido group at the 2-position vary in their reactivity and color tone according to the kind and the amount of a high boiling solvent employed. To obtain a monochromatic image through color development, therefore, yellow, magenta and cyan couplers are preferably contained in identical oil drops so that the relative coupling rate is determined using an identical high boiling coupler in equal amounts.

According to the invention, the relative rate of coupling of the magenta coupler being higher than that of the yellow or cyan coupler means that the CRR value of the magenta coupler is closer to 1.0 than that of the yellow or cyan coupler, and it is preferred that the CRR value of the magenta coupler (denoted as CRR-M), that of the yellow coupler (CRR-Y) and that of the cyan coupler (CRR-C) satisfy the following relationship:

$$0.8<CRR\text{-}M/CRR\text{-}Y<1.0$$

$$0.8<CRR\text{-}M/CRR\text{-}C<1.0;$$

Either of CRR-Y and CRR-C may be larger than or equal to the other. When the coupling rate ratio does not fall within the above range, there were produced problems such that superior neutrality was not achieved, the yield of finished sepia-toned prints by the printer button operation was lowered, coating was limited due to increased addition of couplers, or troubles in physical properties such as bleeding occurred, leading to lowering of effects of the invention.

Yellow, magenta and cyan couplers used in the invention include those known in the photographic art.

Next, the coupler represented by formula (1) will be detailed. In formula (1) afore-mentioned, $R_1$ and $R_2$ each represent a hydrogen atom or a substituent, k and l each represent an integer of 1 to 5, provided that when k or l is 2 or more, plural $R_1$s or plural $R_2$s may be the same with or different from each other and X represents a group capable of being released when being coupled with an oxidation product of an aromatic primary amine color developing agent to form a dye. Examples of the substituent represented by $R_1$ and $R_2$ include a halogen atom, and alkyl, cycloalkyl, aryl and heterocyclic groups, which may be bonded directly or through a bivalent atom or group. Examples of the bivalent atom or group include oxygen atom, nitrogen atom, sulfur atom, carbonylamino, aminocarbonyl, sulfonylamino, aminosulfonyl, amino, carbonyl, carbonyloxy, oxycarbonyl, ureylene, thioureylene, thiocarbonylamino, sulfonyl, sulfonyloxy, and oxycarbonylamino. The alkyl, cycloalkyl, aryl and heterocyclic groups cited as examples of the substituent represented by $R_1$ and $R_2$ may be substituted. Examples of substituents include a halogen atom, nitro, cyano, alkyl, alkenyl, cycloalkyl, aryl, alkoxy, aryloxy, alkoxycarbonyl, aryoxycarbonyl, carboxy, sulfo, sulfamoyl, carbamoyl, acylamino, ureido, urethane, sulfonamido, heterocyclic group, arylsulfonyl, alkylsulfonyl, arylthio, alkylthio, alkylamino, anilino, hydroxy, imido, and acyl.

Examples of the group releasable when coupled with an oxidation product of an aromatic primary amine color developing agent to form a dye, represented by X, include a halogen atom, alkoxy, aryloxy, heterocyclic-oxy, acyloxy, alkylthio, arylthio, heterocyclic-thio,

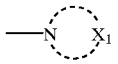

(in which $X_1$ represents an atomic group necessary to form a 5- or 6-membered ring containing a nitrogen atom and an atom selected from the group of carbon atom, oxygen atom, nitrogen atom and sulfur atom), acylamino, and sulfonamido.

Exemplary examples are shown below.

Halogen atom: chlorine, bromine, iodine atoms

Alkoxy group:

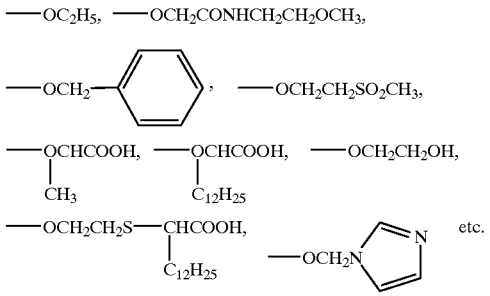

Aryloxy group:

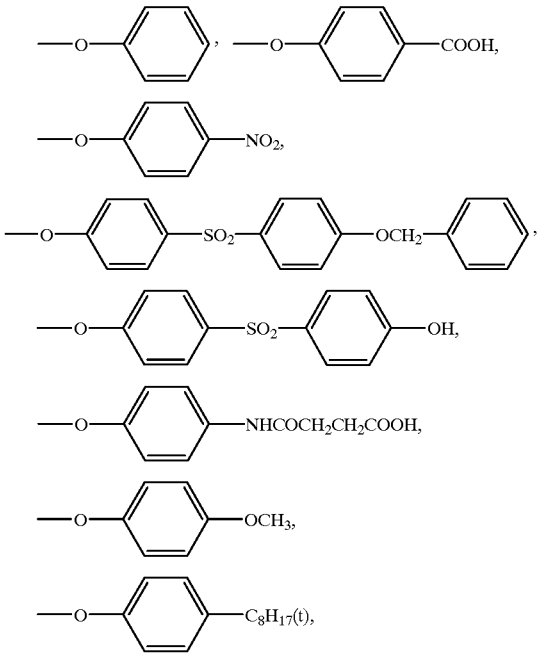

-continued
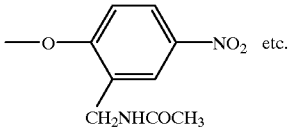
Heterocyclic-oxy group:
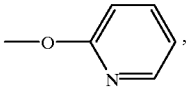
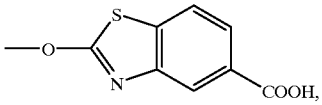
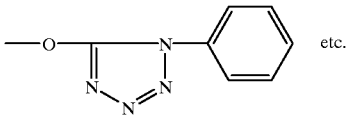
Acylthio group:
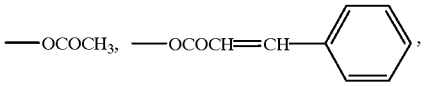
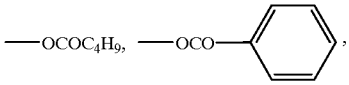
$—OCOCH_2CH_2COOH$ etc.
Alkylthio group:
$—SCH_3$, $—SC_2H_5$, $—SC_8H_{17}$, $—SC_{12}H_{25}$,
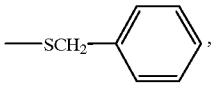
, $—SCH_2CH_2N(C_2H_5)_2$,
$—SCH_2COOC_2H_5$, $—SCH_2CH_2OC_2H_5$,
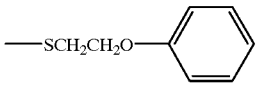
etc.
Arylthio group:
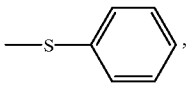
,
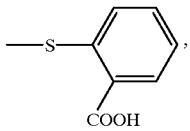
,
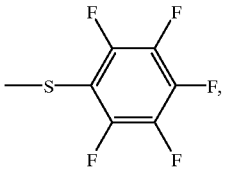
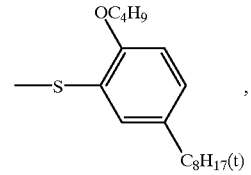
,
-continued
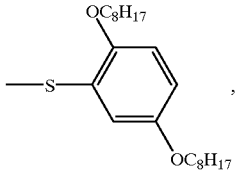
,
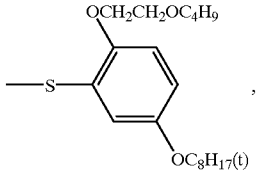
,
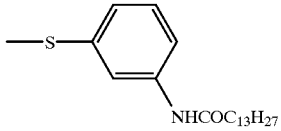
etc.
Heterocyclic-thio group:
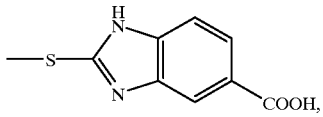
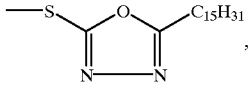
,
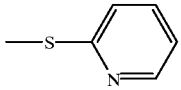
etc.
pyrazolyl, imidazolyl, triazolyl, tetrazolyl,
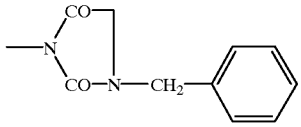
,
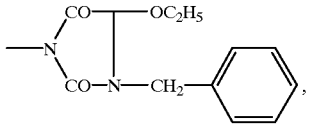
,
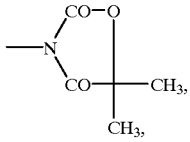
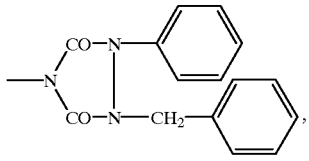
,
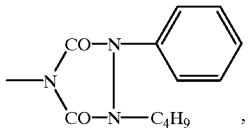
,
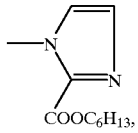
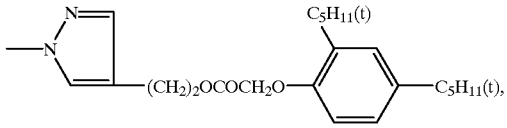
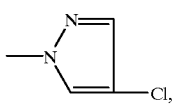
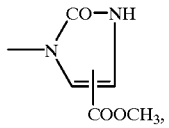
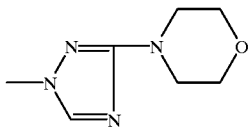
,
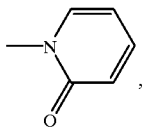
, -continued

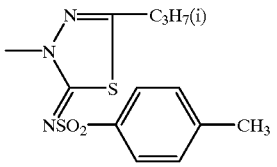

etc.

Acylamino group:

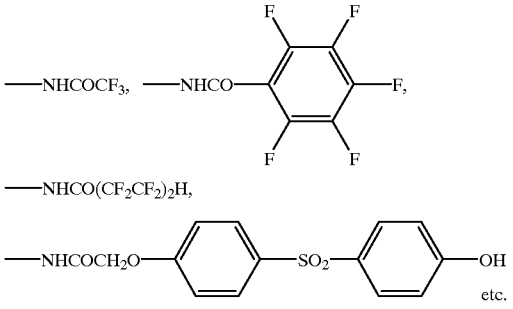

Sulfonamido group:

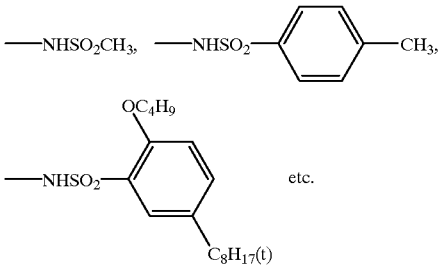

Alkylene group:

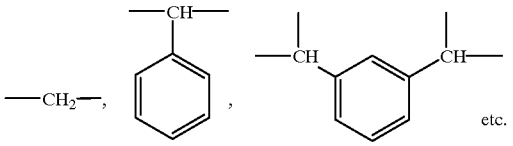

In the coupler represented by formula (1) (yellow coupler), X is preferably aryloxy or

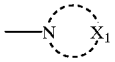

(in which $X_1$ is the same as defined in X1 above-described). Further, the formula (1) includes dimer or higher polymers which are formed by $R_1$, $R_2$ or X.

The coupler represented by formula (2) will be further described below. In formula (2), $R_3$ represents a substituent, $R_2$ and l each are the same as defined in formula (1), provided that when l is 2 or more, plural $R_2$s may be the same with or different from each other, and X represents a group which is the same as defined in formula (1), provided that the group is bonded, through a nitrogen atom, to the 4-position of a pyrazolone ring.

Examples of $R_2$ include the same groups as exemplified in $R_2$ of formula (1). Examples of the substituent represented by $R_3$ alkyl, cycloalkyl, aryl and heterocyclic groups. These groups may be substituted and examples of substituents include those cited in $R_1$ and $R_2$ of formula (1). In couplers (magenta coupler) represented by formula (2), examples of X include those of formula (1) and preferred thereamong are pyrazolyl, imidazolyl, triazolyl, tetrazolyl and

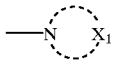

(in which $X_1$ is the same as defined in $X_1$ above-described). Further, the formula (1) includes dimer or higher polymers which are formed by $R_2$, $R_3$ or X.

The coupler represented by formula (3) will be further described below. In formula (3), $R_2$ and $R_3$ each are the same as defined in formula (2), p represents an integer of 1 to 4, provided that when p is 2 or more, plural $R_2$s may be the same with or different from each other, and X is a hydrogen atom or the same as defined in formula (1). Examples of $R_2$ and $R_3$ include those exemplified as $R_2$ and $R_3$ of formula (2).

The coupler represented by formula (4) will be further described below. In formula (4), $R_2$ and l are the same as defined in formula (2), provided that when l is 2 or more, $R_2$ may be the same with or different from each other, X is the same as defined in formula (1) and Q represents a substituent having an ethylenic unsaturated double bond. Examples of $R_2$ and X include those exemplified in formula (1). Q is preferably one represented by the following formula (4A):

formula (4A)

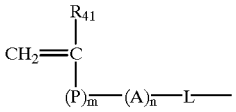

wherein $R_{41}$ represents a hydrogen atom, a halogen atom, or alkyl (preferably a lower alkyl having 1 to 4 carbon atoms, such as methyl, ethyl and t-butyl), which may be substituted; L represents a bivalent group, —CONH—, —NHCONH— or —NH—; P represent a bivalent group, —CONH—, —$SO_2$— or —COO— (preferably, —CONH— or —COO—); A represents a bivalent group of alkylene (preferably, alkylene having 1 to 10 carbon atoms) or phenylene. The alkylene group may be straight chained or branched, and examples thereof include methylene, methylmethylene, dimethylene and decamethylene and the alkylene and phenylene may be substituted; and m and n each are 0 or 1. In formula (4A) is preferably L of —CONH— or —NH—, n of 0 or 1, A of m-phenylene, m of 0 or 1, p of —CONH— and $R_{41}$ of lower alkyl; and more preferably L of —CONH—, m of 0, n of 0 and $R_{41}$ of a lower alkyl, specifically, methyl. The alkylene and phenylene groups represented by A may be substituted, and examples of substituents include aryl (e.g. phenyl), nitro, hydroxy, cyano, sulfo, alkoxy (e.g. ethoxy), acyloxy (e.g. acetoxy), acylamino (e.g. acetylamino), sulfonamido (e.g. methanesulfoneamido), sulfamoyl (e.g. methylsulfamoyl), halogen atom (e.g. fluorine, chlorine, bromine), carboxy, carbamoyl (e.g. methylcarbamoyl), alkoxycarbamoyl (e.g. methoxycarbamoyl) and sulfonyl (e.g. methylsulfonyl). The alkylene or phenylene group may be substituted by two or more of these substituent, in which the substituents may be the same with or different from each other. In the invention is employed a polymer coupler obtained by polymerizing a coupler monomer represented by formula (4). Exemplary examples of the coupler monomer represented by formula (4) are shown below, but the present invention is not limited to these examples.

(MM-1)

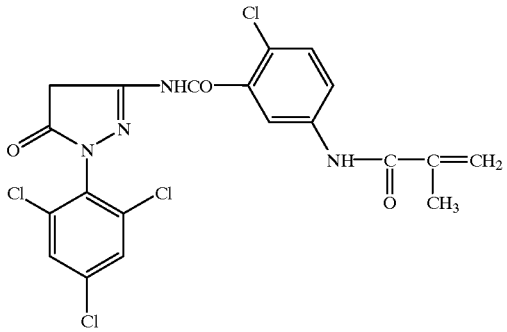

(MM-2)

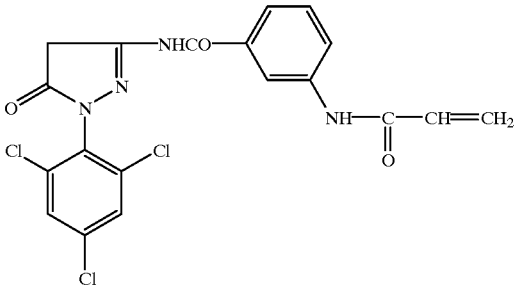

(MM-3)

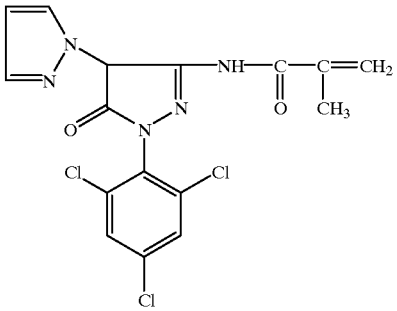

(MM-4)

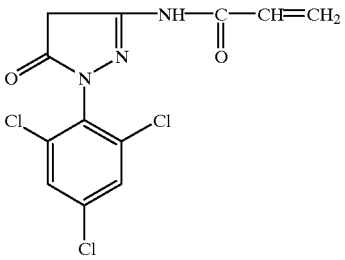

-continued (MM-5)

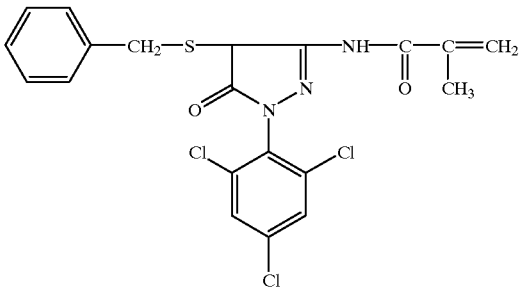

(MM-6)

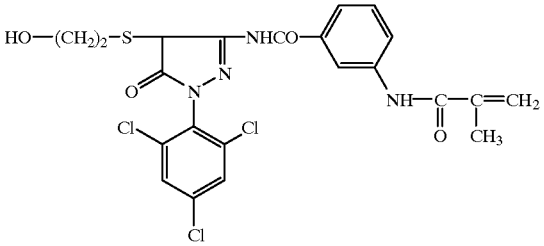

(MM-7)

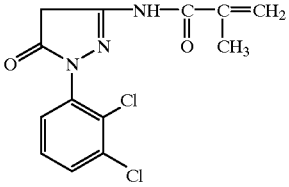

(MM-8)

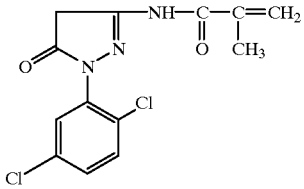

Exemplary examples of the polymer coupler obtained by polymerizing the coupler monomer represented by formula (4) are shown below, but the present invention is not limited to these examples.

4M-1
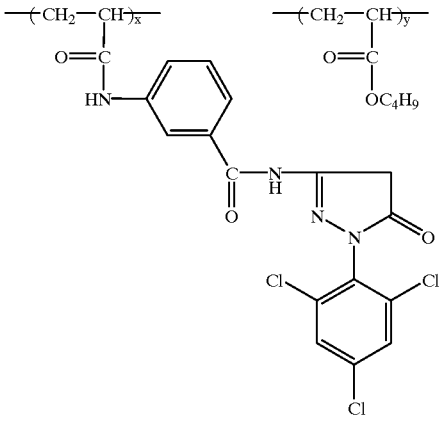
x:y = 80:20 (weight ratio)
4M-2
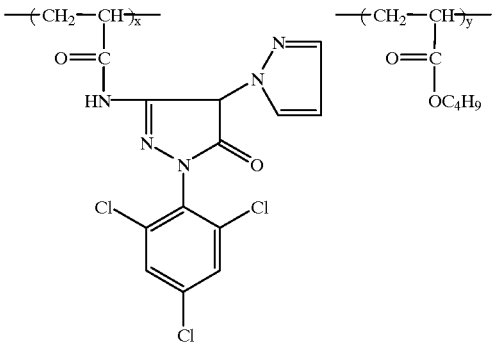
x:y = 60:40 (weight ratio)
4M-3
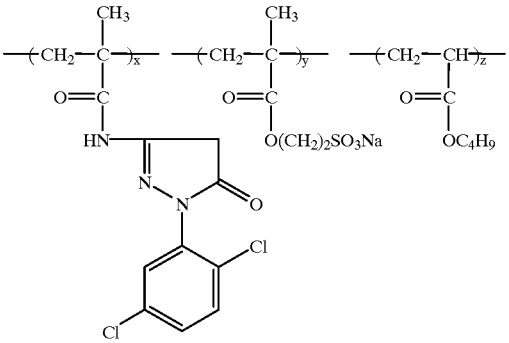
x:y:z = 85:5:10 (weight ratio)
4M-4
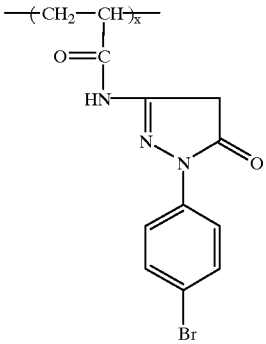
x = 100 weight %
4M-5
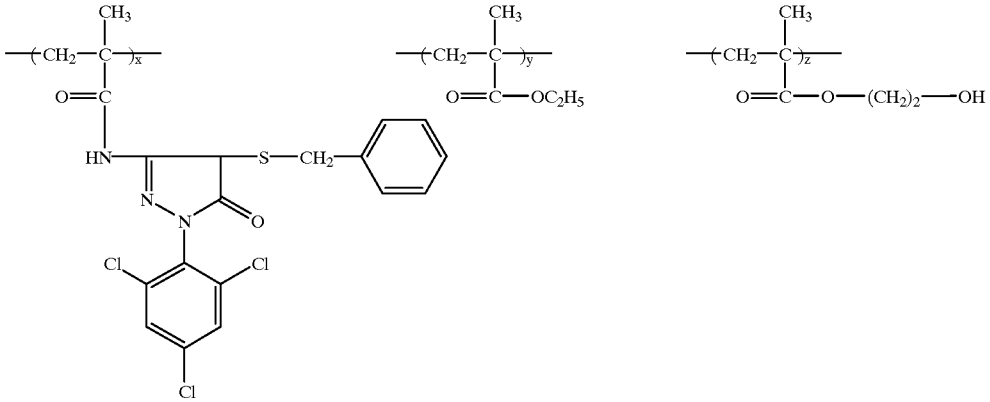
x:y:z = 85:15:5 (weight ratio)

-continued 4M-6

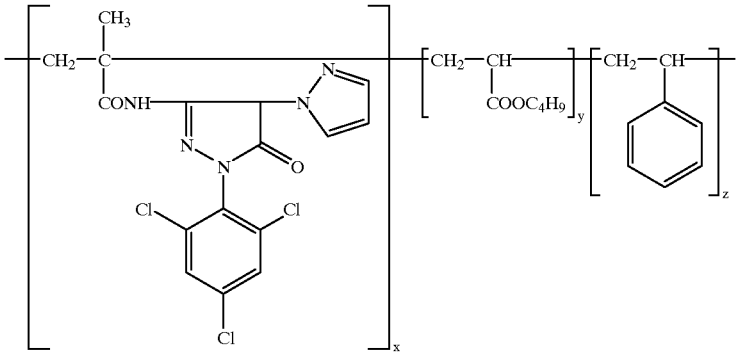

x:y:z = 50:25:25 (weight ratio)

4M-7

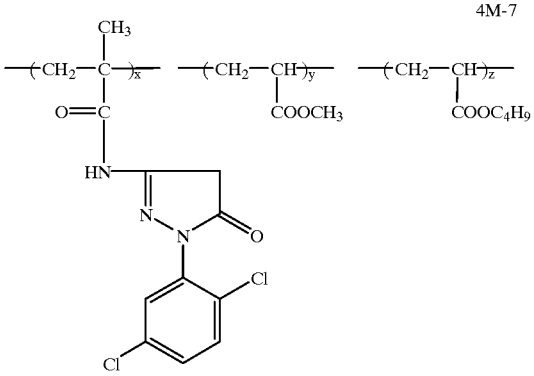

x:y:z = 50:25:25 (weight ratio)

4M-8

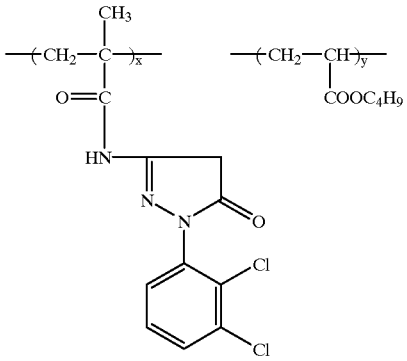

x:y = 70:30 (weight ratio)

The coupler represented by formula (5) will be further described below. In formula (5), $R_1$ represents a hydrogen atom or a substituent, k represents an integer of 1 to 5, provided that when k is 2 or more, $R_1$ may be the same with or different from each other, and X is the same as defined in formula (1). The formula (5) include diner or higher polymer, which are formed by linking through $R_1$ or X.

The coupler represented by formula (6) will be further described below. In formula (6), $R_3$ represents a substituent, $R_2$ and l are the same as defined in formula (1), provided that when l is 2 or more, $R_2$ may be the same with or different from each other, and X is the same group as defined in formula (1), provided that the group is bonded, through a sulfur atom, to the 4-position of a pyrazolone ring. Examples of $R_2$ include those exemplified as $R_2$ in formula (1). Examples of $R_3$ include alkyl, cycloalkyl, aryl and heterocyclic groups. These groups may be substituted, and examples of substituent include those exemplified as the substituent in $R_1$ and $R_2$ of formula (1). Example of X include those exemplified as X in formula (1), and thereamong are preferred alkylthio, arylthio or heterocyclic-thio group. The formula (6) include dimer or higher polymer, which are formed by linking through $R_2$, $R_3$ or X.

The coupler represented by formula (7) will be further described below. In formula (7), $R_2$ and $R_3$ are the same as defined in formula (2), $R_4$ represents a substituent, n represents an integer of 1 or 2, provided that when n is 2, $R_2$ may be the same with or different from each other, and X is a hydrogen atom or the same group as defined in formula (1). Examples of $R_2$ and $R_3$ include those exemplified as $R_2$ and $R_3$ in formula (2). Examples of $R_4$ include those exemplified as $R_4$ in formula (2). In the coupler (cyan coupler) represented by formula (7), example of X include those exemplified as X in formula (1), and thereamong are preferred a halogen atom, alkoxy, aryloxy and sulfonamido. The formula (7) include dimer or higher polymer, which are formed by linking through $R_2$, $R_3$, $R_4$ or X.

Exemplary examples of the couplers represented formulas (1) through (3) and (5) through (7) are shown below, but the present invention is not limited to these examples.

1Y-1
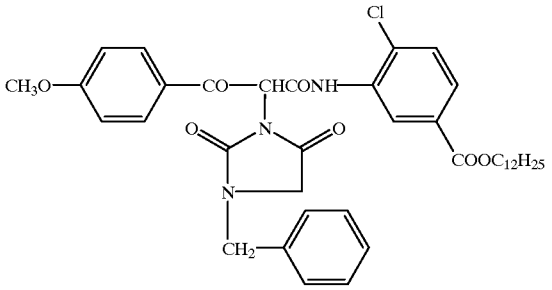
1Y-2
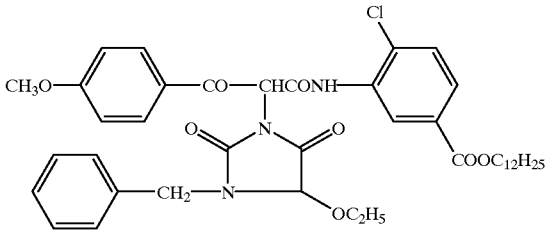
1Y-3
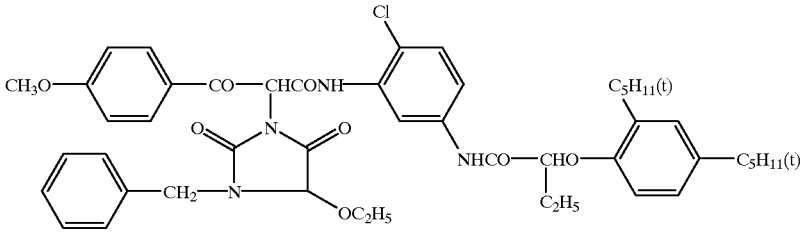
1Y-4
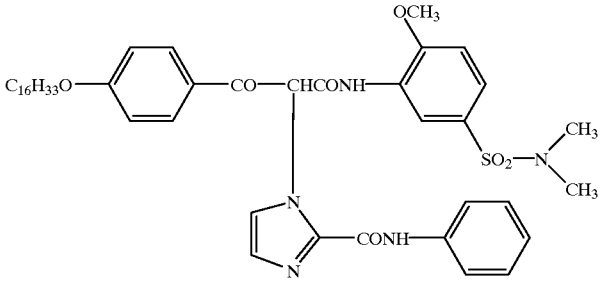
1Y-5
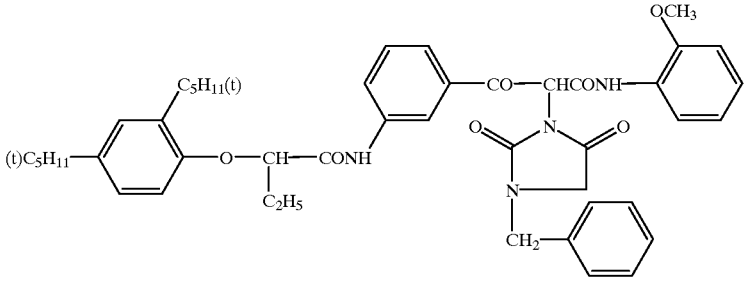
1Y-6
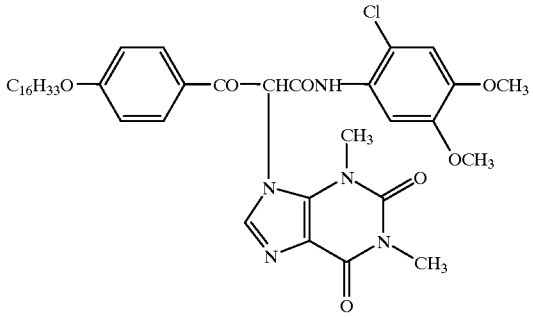
1Y-7
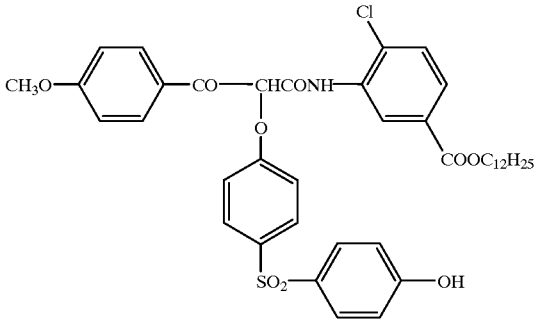

-continued
1Y-8
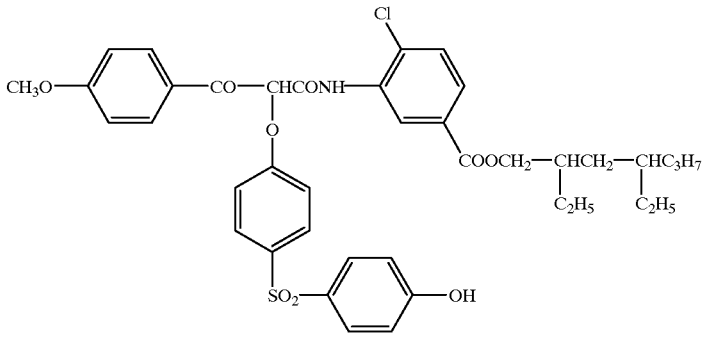
2M-1
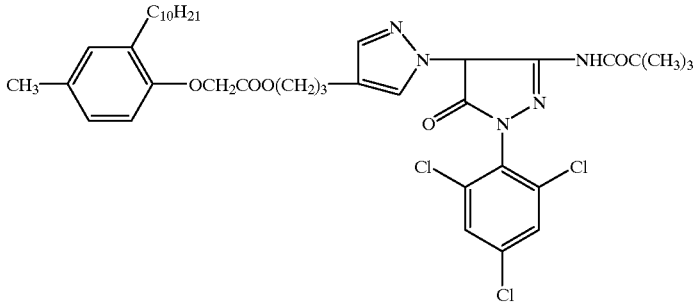
2M-2
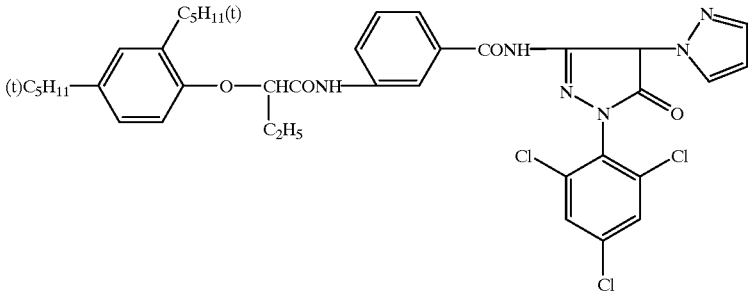
2M-3
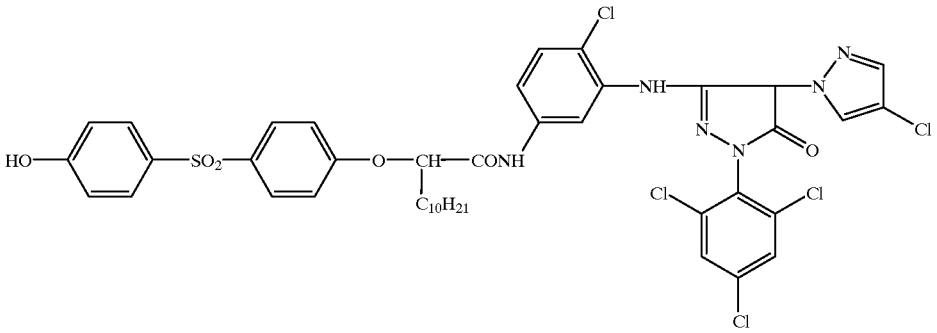
2M-4
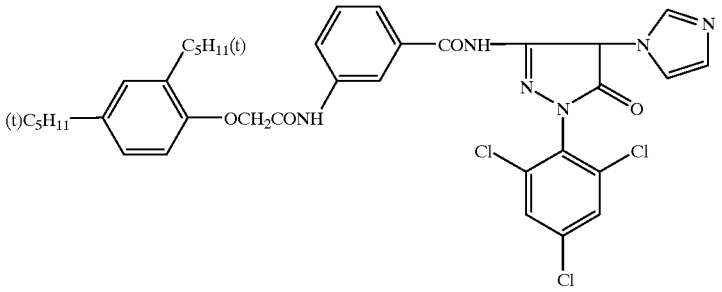

-continued
2M-5
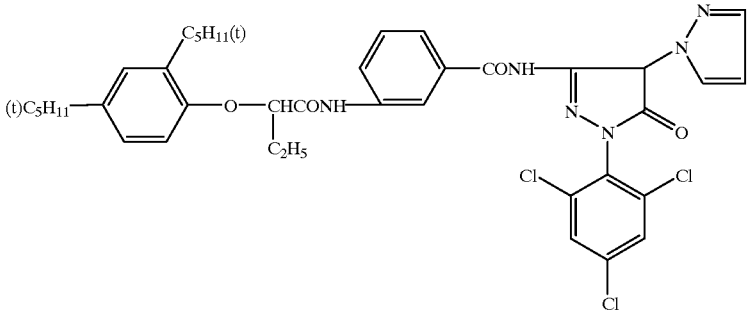
2M-6
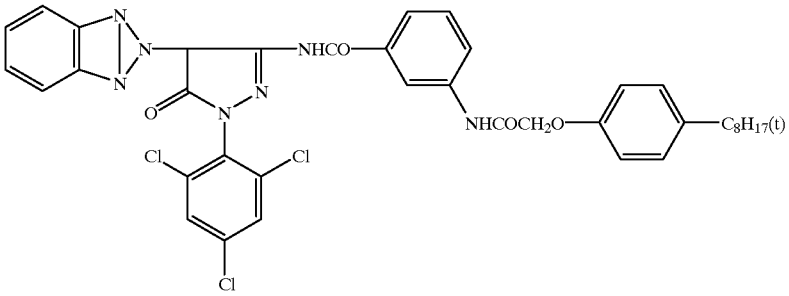
2M-7
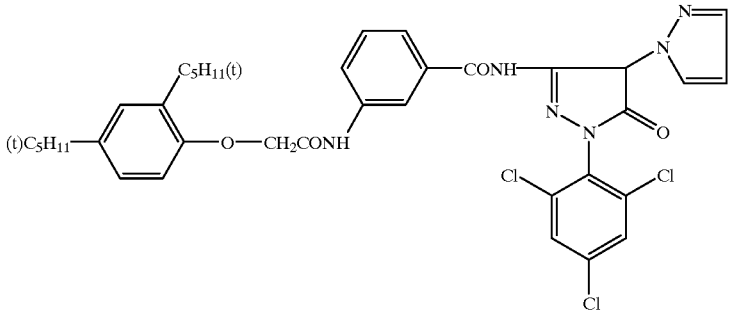
2M-8
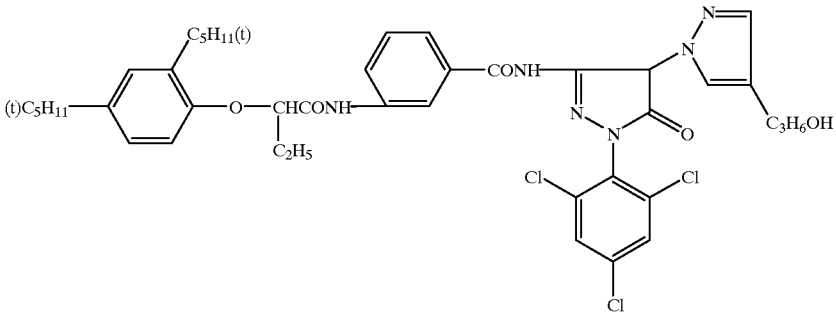

-continued
3C-1
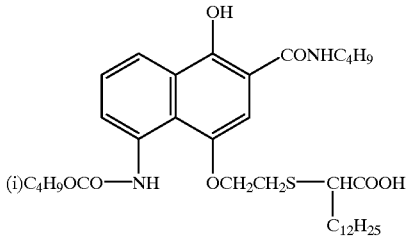
3C-2
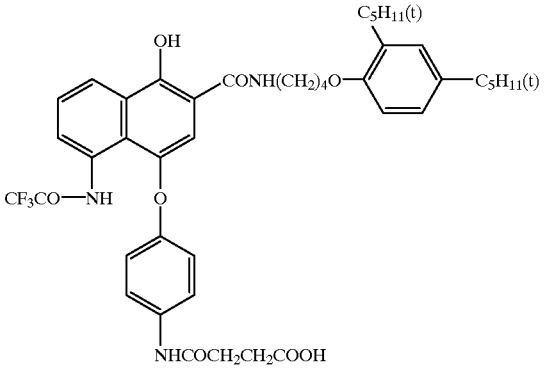
3C-3
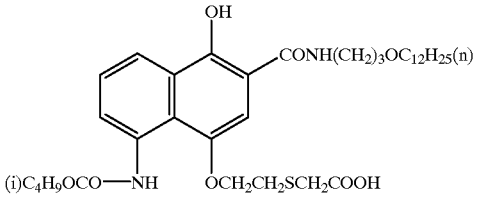
3C-4
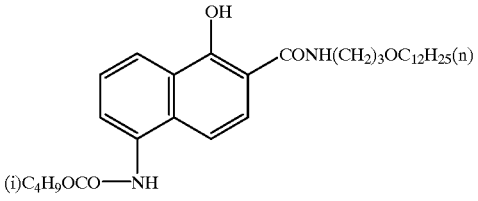
3C-5
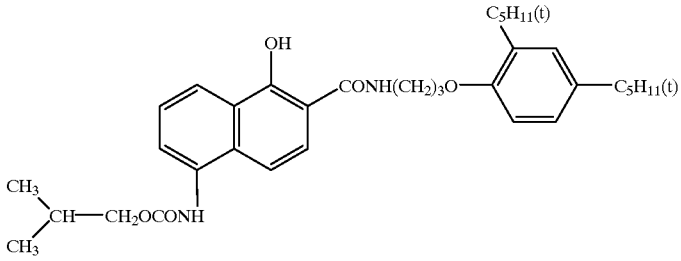
3C-6
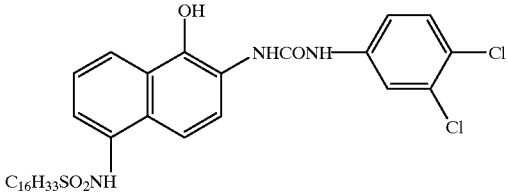
3C-7
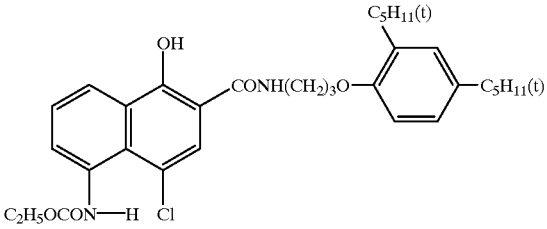
3C-8
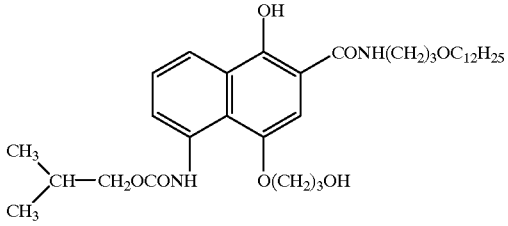

-continued
5Y-1
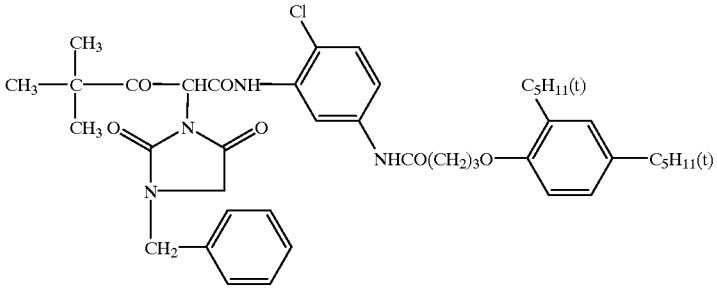
5Y-2
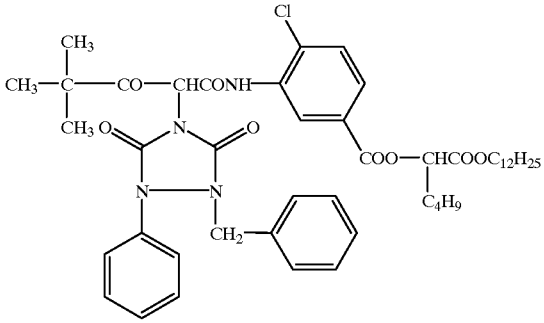
5Y-3
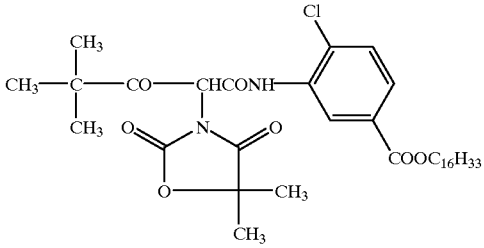
5Y-4
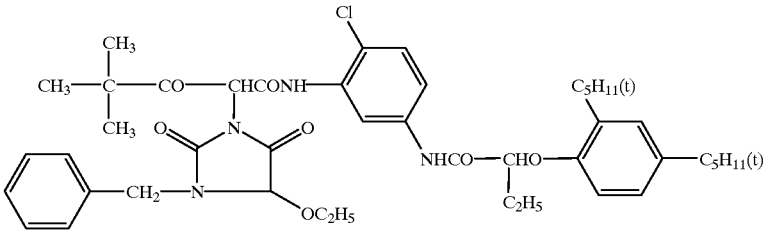
5Y-5
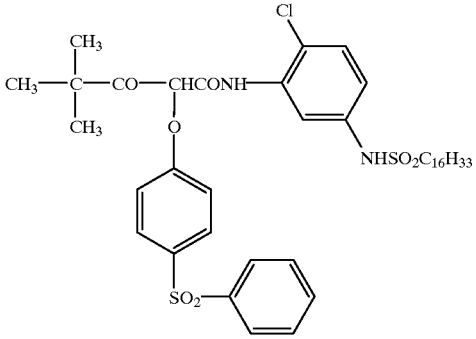
5Y-6
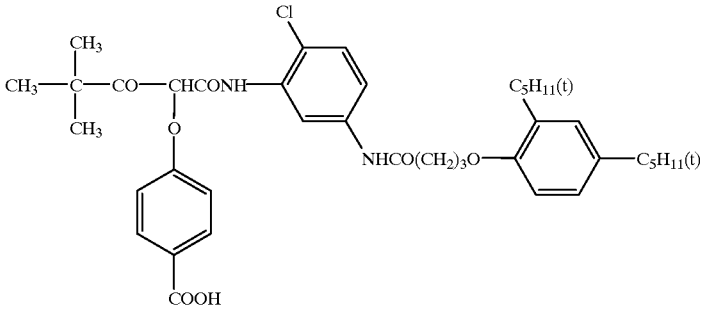

-continued
5Y-7
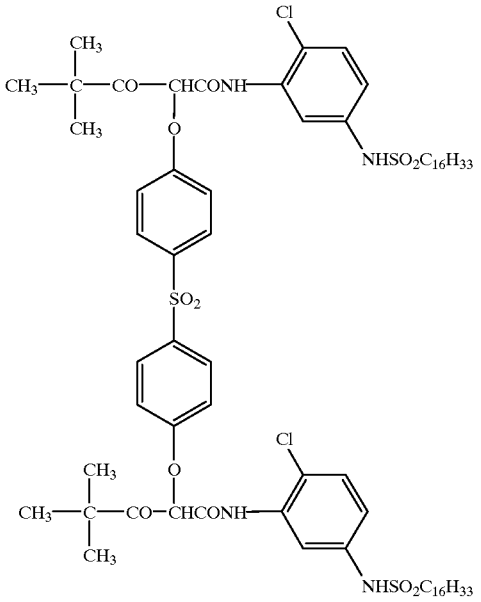
5Y-8
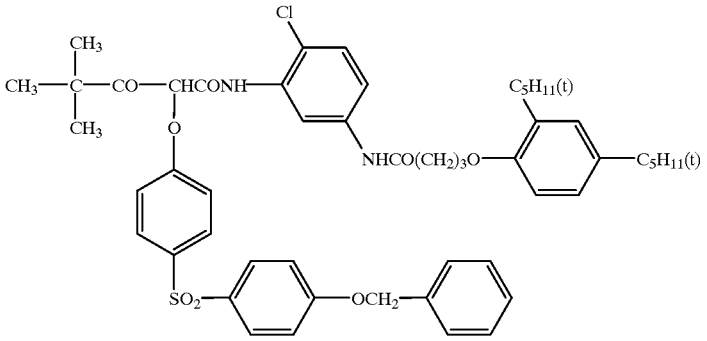
5Y-9
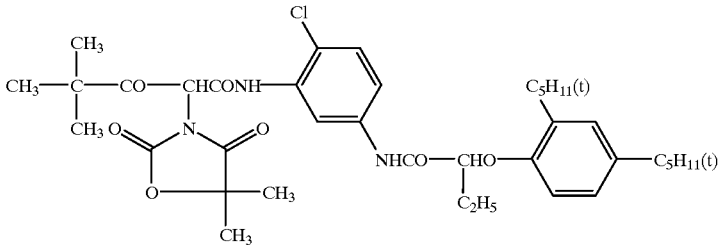
5Y-10
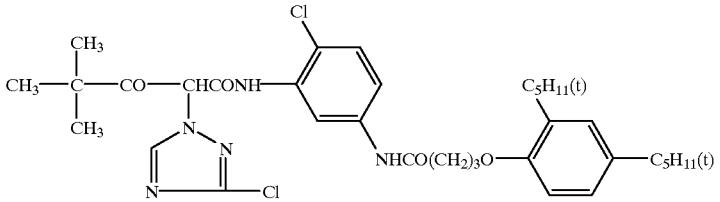

-continued
6M-1
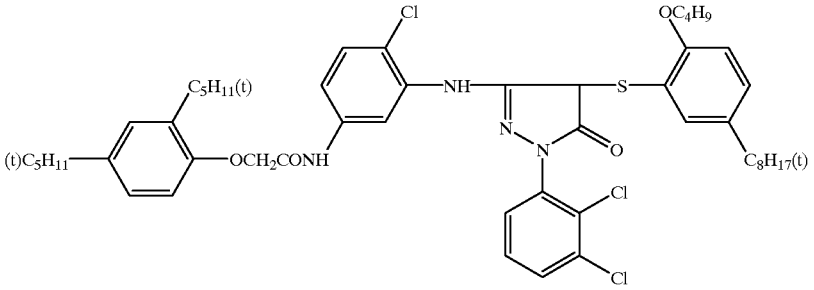
6M-2
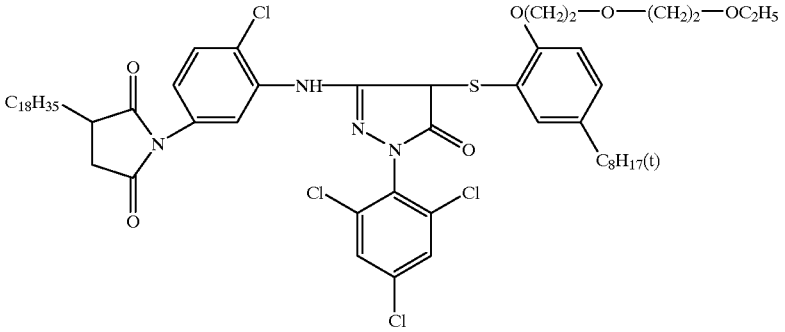
6M-3
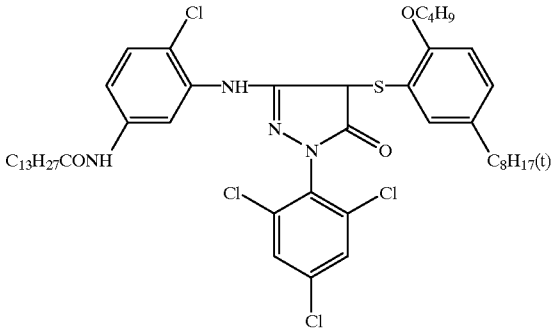
6M-4
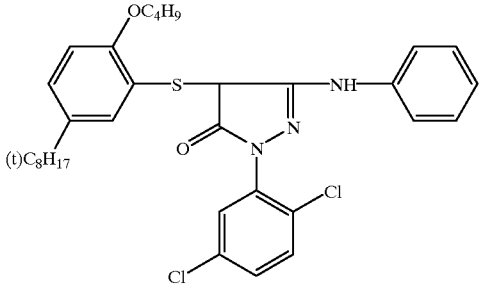
6M-5
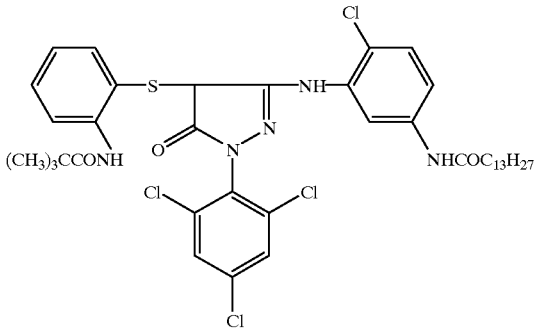

-continued
6M-6
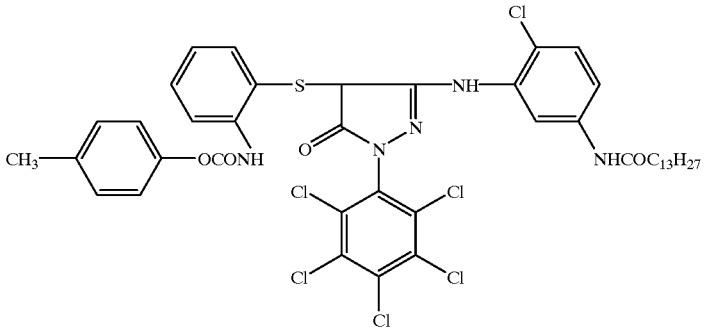
6M-7
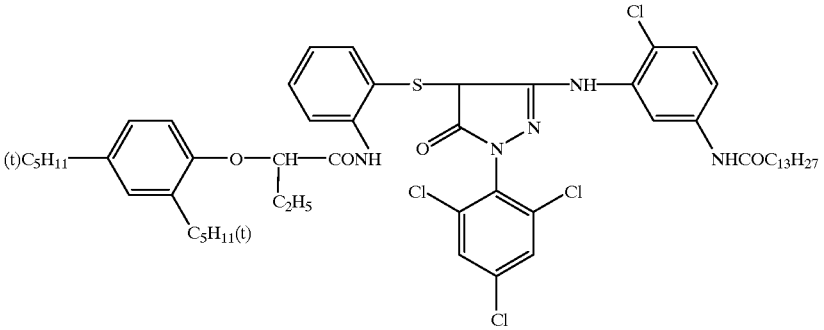
6M-8
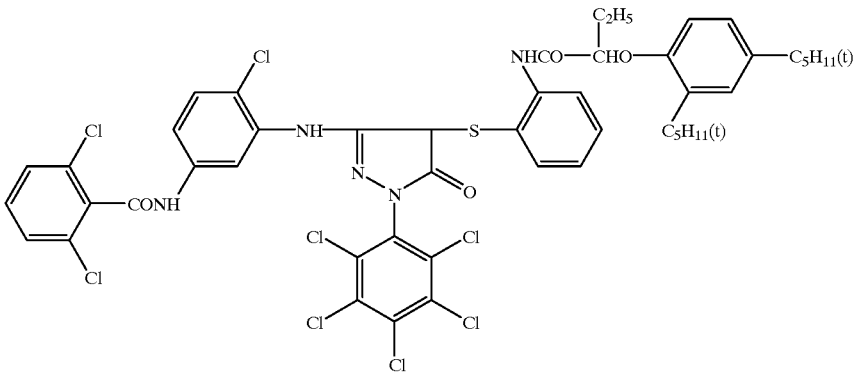
6M-9
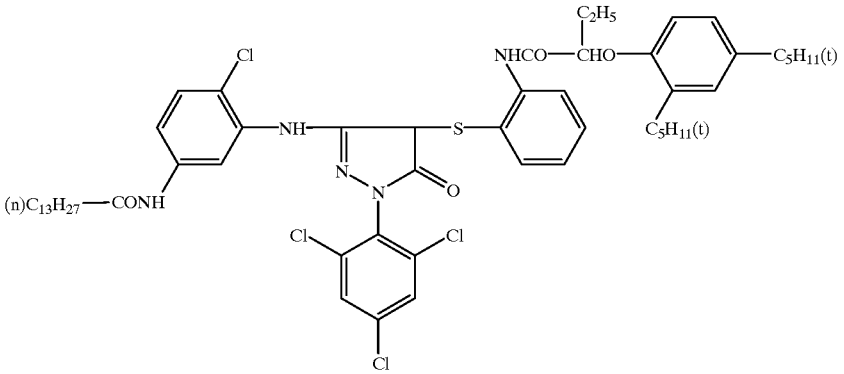

-continued
7C-1
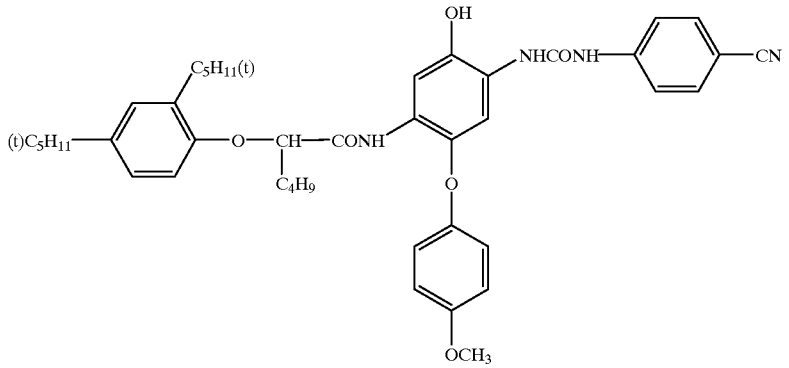
7C-2
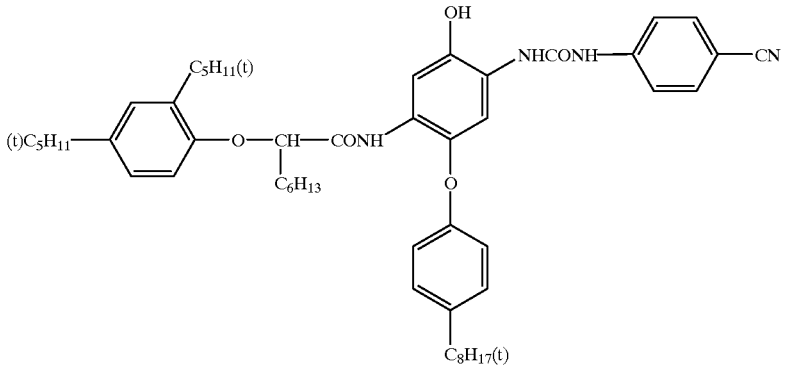
7C-3
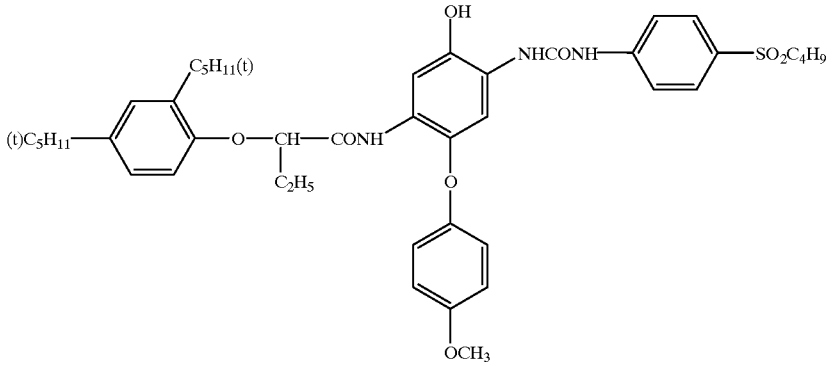
7C-4
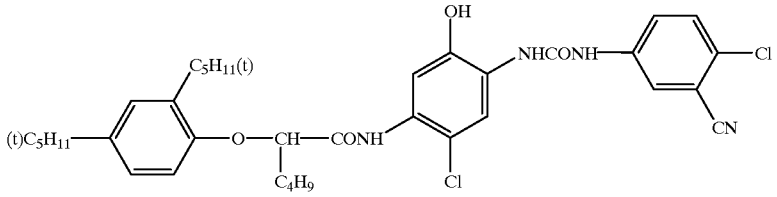
7C-5
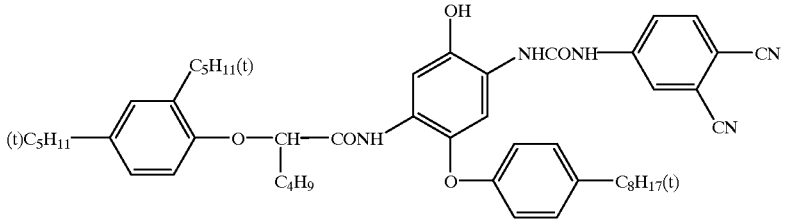

-continued 7C-6

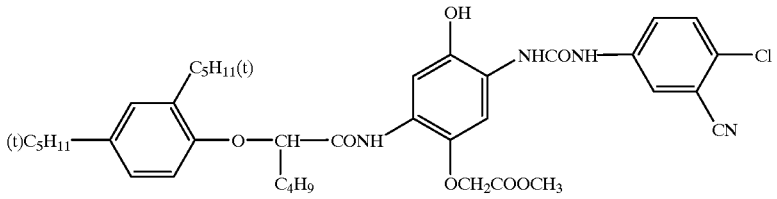

7C-7

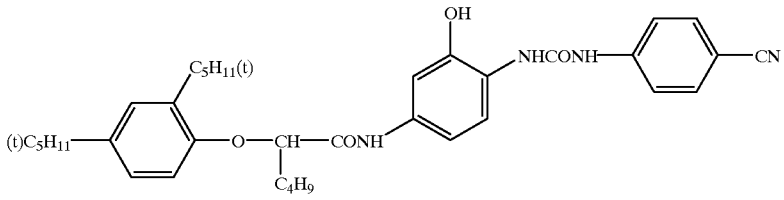

7C-8

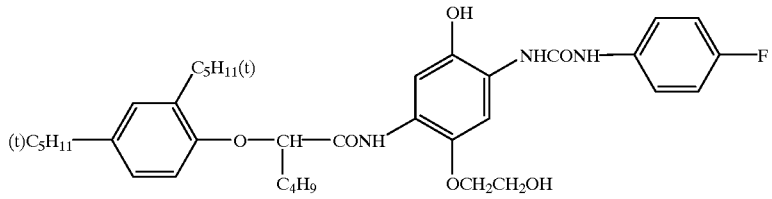

7C-9

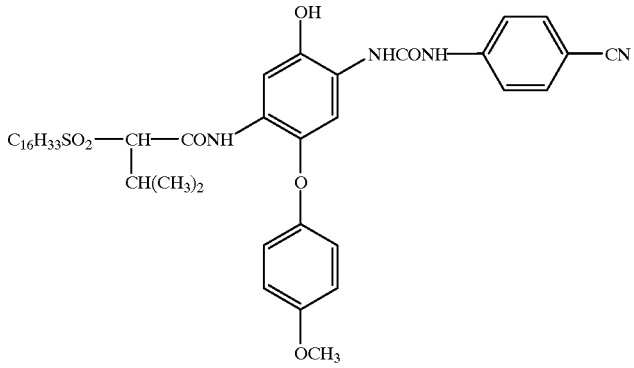

7C-10

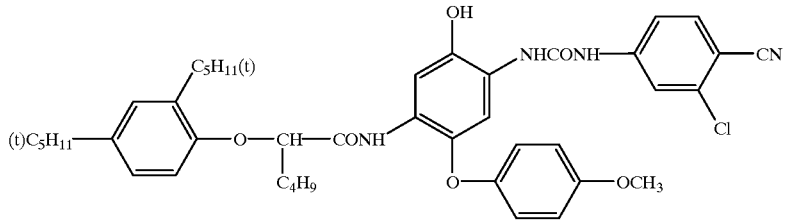

According to the invention, the yellow coupler is incorporated preferably in an amount of $5\times10^{-5}$ to $2\times10^{-3}$ mol/m$^2$, more preferably $1\times10^{-4}$ to $2\times10^{-3}$ mol/m$^2$, and still more preferably $2\times10^{-4}$ to $2\times10^{-3}$ mol/m$^2$; the magenta coupler is incorporated preferably in an amount of $2\times10^{-5}$ to $1\times10^{-3}$ mol/m$^2$, more preferably $5\times10^{-5}$ to $2\times10^{-3}$ mol/m$^2$, and still more preferably $1\times10^{-4}$ to $1\times10^{-3}$ mol/m$^2$; the cyan coupler is incorporated preferably in an amount of $5\times10^{-5}$ to $2\times10^{-3}$ mol/m$^2$, more preferably $1\times10^{-4}$ to $2\times10^{-3}$ mol/m$^2$, and still more preferably $2\times10^{-4}$ to $2\times10^{-3}$ mol/m$^2$.

To incorporate a coupler used in the invention into a silver halide emulsion, the coupler is dissolved in a high boiling solvent optionally with a low boiling solvent, mixed with an aqueous gelatin solution containing a surfactant and dispersed by means of a high-speed mixer, colloid mill, ultrasonic homogenizer or capillary tube type dispersing machine to form an emulsion. Examples of the high boiling solvent used include carboxylic acid esters, carboxylic acid amides, ethers and substituted hydrocarbons, such as di-n-butyl phthalate, di-iso-octyl phthalate, di-methoxyethyl phthalate, di-n-butyl adipate, di-iso-octyl adipate, tri-n-butyl citrate, butyl laurate, di-n-butyl cebacate, tricresyl phosphate, tri-n-butyl phosphate, tri-iso-octyl phosphate, N,N-diethyl caproic acid amide, N,N-dimethylpalmitic acid amide, n-butylpentadecyl phenyl ether, ethyl-2,4-di-tert-butyl phenyl ether, octyl succinate, and dioctyl maleate. Examples of the low boiling solvent include ethyl acetate, butyl acetate, cyclohexane and butyl propionate.

The silver halide photographic light sensitive material of the invention, i.e. monochromatic image-forming silver halide photographic material preferably contain a colored coupler. The colored coupler is known in the photographic art, which has color even in the unreacted state and which may form dye images such as yellow, magenta, cyan or black images, or may not form any color image. In general, the colored coupler is referred to as one having different colors before and after color development. A colored coupler preferably used in the invention is at least one selected from a yellow-colored magenta coupler, a magenta-colored cyan coupler and a yellow-colored cyan coupler, and will be further described below.

In the invention, the yellow-colored magenta coupler is referred to as a magenta coupler having an absorption maximum at 400 to 500 nm within the visible absorption region and capable of forming a magenta dye having an absorption maximum at 510 to 580 nm within the visible absorption region. A yellow-colored magenta coupler preferably used in the invention is represented by the following formula (I):

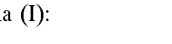

formula (I)

wherein Cp represents a magenta coupler moiety, the coupling position of which is bonded to an azo group, and $R_1$ represents substituted or unsubstituted aryl group. The magenta coupler moiety represented by Cp is preferably one derived from a 5-pyrazolone magenta coupler or pyrazolotriazole type magenta coupler. and more preferably the moiety represented by the following formula (II):

formula (II)

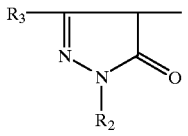

wherein $R_2$ represents a substituted or unsubstituted aryl group and $R_3$ represents an acylamino group, anilino group, ureido group or carbamoyl group, which may be substituted. The aryl group represented by $R_2$ is preferably phenyl. Examples of substituents for the aryl group include a halogen atom, alkyl (e.g. methyl, ethyl etc.), alkoxy (e.g. methoxy, ethoxy etc.), aryloxy (e.g. phenyloxy, naphthyloxy etc.), acylamino [e.g. benzamido, α-(2,4-di-t-aminophenoxy)butylamido etc.], sulfonylamino (e.g. benzene-sulfonamido, n-hexadecanesulfonamido etc.), sulfamoyl (e.g. methylsulfamoyl, phenylsulfamoyl etc.), carbamoyl (e.g. n-butylcarbamoyl, phenylcarbamoyl etc.), sulfonyl (e.g. methylsulfonyl, n-dodecylsulfonyl etc.), acyloxy, ester group, carboxy, sulfo and nitro. Examples of $R_2$ include phenyl, 2,4,6-trichlorophenyl, pentachlorophenyl, pentafluorophenyl, 2,4,6-trimethylphenyl, 2-chloro-4,6-dimethylphenyl, 2,6-dichloro-4-methylphenyl, 2,4-dichloro-6-methylphenyl, 2,4-dichloro-6-methoxyphenyl, 2,6-dichloro-4-methoxyphenyl, and 2,6-dichloro-4-[α-(24-di-t-amylphenoxy)acetoamido]phenyl. Examples of the acylamino group represented by $R_3$ include pivaroylamino, n-tetradecaneamido, α-(3-pentadecylphenoxy)-butylamido, 3-[α-(2,4-di-t-amylphenoxy)acetoamido]benzamido, benzamido, 3-acetoamidobenzamido, 3-(3-n-dodecysuccinamido)-benzamido and 3-(4-n-dodecyloxybenzenesulfonamido)benzamido. Examples of the anilino group represented by $R_3$ include anilino, 2-chloroanilino, 2,4-dichloroanilino, 2,4-dichloro-5-methoxyanilino, 4-cyanoanilino, 2-chloro-5-[α-(2,4-di-t-amylphenoxy)butylamido]anilino, 2-chloro-5-(3-octadecenylsuccinimido)anilino, 2-chloro-5-n-tetradecaneamidoanilino, 2-chloro-5-[α-(3-t-butyl-4-hydroxyphenoxy)tetradecaneamido]anilino and 2-chloro-5-n-hexadecanesulfonamidoanilino. Examples of the ureido group represented by $R_3$ include methylureido, phenylureido and 3-[α-(2,4-di-t-amylphenoxy)butylamido]phenylureido. Examples of the carbamoyl group represented by $R_3$ include n-tetradecylcarbamoyl, phenyl carbamoyl and 3-[α-(2,4-di-t-amylphenoxy)acetoamido]-phenylcarbamoyl. The aryl group represented by $R_1$ is preferably phenyl or naphthyl. Examples of substituent for the aryl group represented by $R_1$ include a halogen atom, alkyl, alkoxy, aryloxy, hydroxy, acyloxy, carboxy, alkoxycarbonyl, aryloxycarbonyl, alkylthio, arylthio, alkylsulfonyl, arylsulfonyl, acyl, sulfonamido, carbamoyl and sulfamoyl. Of these are preferred alkyl, hydroxy, alkoxy and acylamino.

Exemplary examples of the yellow-colored magenta coupler represented by formula (I) include YCM-1 to YCM-20 described Japanese Patent Application No. 8-136765, at page 60–67, but are not limited to these. The yellow-colored magenta coupler preferably used in the invention may be incorporated into any layer of the photographic material. In cases where incorporated into a light sensitive silver halide emulsion layer, the amount to be incorporated is preferably 0.001 to 0.1, more preferably 0.005 to 0.05, and still more preferably 0.01 to 0.03 mol per mol of silver halide.

In the invention, the magenta-colored cyan coupler is referred to as a cyan coupler having an absorption maximum at 500 to 600 nm within the visible absorption region and capable of forming a cyan dye having an absorption maximum at 630 to 750 nm within the visible absorption region. A magenta-colored cyan coupler preferably used in the invention is represented by the following formula (III):

formula (III)

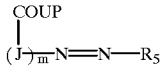

wherein COUP represents a cyan coupler moiety, J represents a bivalent linkage, m is 0 or 1 and $R_5$ represents an aryl group.

The cyan coupler moiety represented by COUP is a phenol type cyan coupler moiety and a naphthol type cyan coupler moiety, and preferably a naphthol; type cyan coupler. The bivalent linkage represented by J is preferably represented by the following formula (IV):

formula (IV)

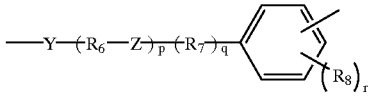

wherein Y represents

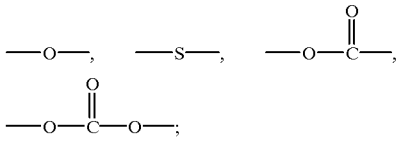

R6 represents an alkylene group having 1 to 4 carbon atoms or arylene group; $R_7$ an alkylene group having 1 to 4 carbon atoms, provided that the alkylene group represented by $R_6$ or $R_7$ may be substituted by alkyl, carboxy, hydroxy or sulfo; Z represents —C($R_9$) ($R_{10}$)—, —O—, —S—, —SO—, —$SO_2$—, $SO_2$NH—, CONH—, —COO—, —NHCO—, NH$SO_2$—, or —OCO—, in which $R_9$ and $R_{10}$ represent an alkyl group or an aryl group; $R_8$ represents an alkyl group, aryl group, heterocyclic group, hydroxy, cyano, nitro, sulfonyl, alkoxy, aryloxy, carboxy, sulfo, halogen atom, carbonamido group, sulfonamido group, carbamoyl group, alkoxycarbonyl or sulfamoyl; p represents 0 or a positive integer; q represents 0 or 1; r represents an integer of 1 to 4.

The aryl group represented by $R_5$ is preferably a phenyl or naphthyl group, when m is 0. The phenyl and naphthyl groups each may be substituted by an atom or group, such as a halogen atom, alkoxy, aryloxy, hydroxy, acyloxy, carboxy, alkoxycarbonyl, aryloxycarbonyl, mercapto, alkylthio, arylthio, alkylsulfonyl, arylsulfonyl, acyl, acylamino, sulfonamido, carbamoyl and sulfamoyl. When m is 1, the aryl group represented by $R_5$ is preferably a naphthol group represented by the following formula (V):

formula (V)

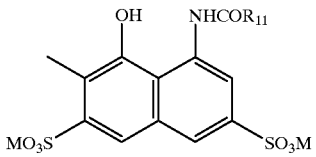

wherein $R_{11}$ a straight-chained or branched alkyl having 1 to 4 carbon atoms (e.g. methyl, ethyl, propyl, isopropyl, butyl, s-butyl, t-butyl); and M represents a photographically inert cation, including a hydrogen atom, alkaline metal atom such as sodium or potassium, ammonium methylammonium, ethylammonium, diethylammonium, triethylammonium, ethanolammonium, diethanolammonium, pyridinium, piperidinium, anilinium, toluidinium, p-nitroanilinium, and anindium. Exemplary examples of the magenta-colored cyan coupler represented by formula (III) include MCC-1 through MCC-14, as described in Japanese Patent Application No. 8-136765 page 71–75, but are not limited thereto. The magenta-colored cyan coupler preferably used in the invention may be incorporated into any layer of the photographic material. In cases where incorporated into a light sensitive silver halide emulsion layer, the amount to be incorporated is preferably 0.001 to 0.1, more preferably 0.002 to 0.05, and still more preferably 0.005 to 0.03 mol per mol of silver halide.

In the invention, the yellow-colored cyan coupler is referred to as a cyan coupler having an absorption maximum at 400 to 500 nm within the visible absorption region and capable of forming a cyan dye having an absorption maximum at 630 to 750 nm within the visible absorption region. The yellow-colored cyan coupler preferably used in the invention is represented by the following formula (VI) to (VIII), which is preferably a cyan coupler capable of releasing, upon coupling reaction with an oxidation product of an aromatic primary amine developing agent, a compound residue containing an aqueous soluble 6-hydroxy-2-pyridine-5-ylazo group, an aqueous soluble pyrazolidone-4-ylazo group, aqueous soluble 2-acyaminophenylazo group or aqueous soluble 2-sulfonamido-phenylazo group:

formula (VI)

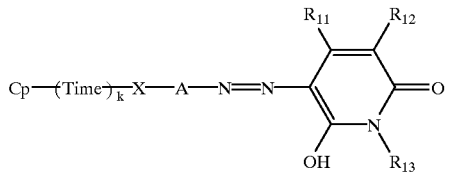

formula (VII)

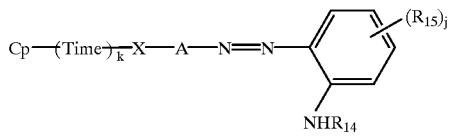

formula (VIII)

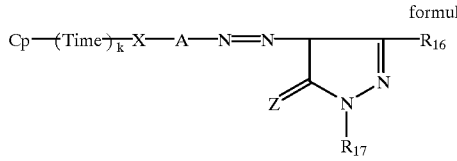

In formulas (VI) to (VIII), Cp represents a cyan coupler moiety, Time represents a timing group (which is bonded to the coupling position of Cp), k represents 0 or 1, X represents a bivalent linkage containing N, O or S and linking $(Time)_k$ and A, and A represents an arylene group or a bivalent heterocyclic group.

In formula (VI), $R_{11}$ and $R_{12}$ independently represent a hydrogen atom, carboxy, cyano, alkyl, cycloalkyl, aryl, heterocyclic group, carbamoyl, sulfamoyl, carbonamido, sulfonamido or alkylsulfonyl; $R_{13}$ represents a hydrogen atom, alkyl, cycloalkyl, aryl, or heterocyclic group, provided that at least one of Time, X, A, $R_{11}$, $R_{12}$ and $R_{13}$ contains a aqueous-solubilizing group (e.g. hydroxy, carboxy, sulfo, ammoniumyl, phosphono, phosphino, hydroxysulfonyloxy, etc.).

In formula (VII), $R_{14}$ represents acyl or sulfonyl, $R_{15}$ represents a substituent, j represents an integer of 0 to 4 and when j is 2 or more, $R_{15}$ may be the same with or different from each other, provided that at least one of Time, X, A, $R_{14}$ and $R_{15}$ contains a aqueous-solubilizing group (e.g. hydroxy, carboxy, sulfo, ammoniumyl, phosphono, phosphino, hydroxysulfonyloxy, etc.).

In formula (VIII), $R_{16}$ represents a hydrogen atom, carboxy, cyano, alkyl, cycloalkyl, aryl, heterocyclic group, carbamoyl, sulfamoyl, carbonamido, sulfonamido or alkylsulfonyl; $R_{17}$ represents a hydrogen atom, alkyl, cycloalkyl, aryl, or heterocyclic group, provided that at least one of Time, X, A, and $R_{16}$ contains a aqueous-solubilizing group (e.g. hydroxy, carboxy, sulfo, ammoniumyl, phosphono, phosphino, hydroxysulfonyloxy, etc.); and Z represents O or NH.

Exemplary examples of the yellow-colored cyan coupler described above include YCC-1 through YCC-20, as described in Japanese Patent Application No. 8-136765 page 76–79, but are not limited thereto. The yellow-colored cyan coupler preferably used in the invention may be incorporated into any layer of the photographic material. In cases where incorporated into a light sensitive silver halide emulsion layer, the amount to be incorporated is preferably 0.001 to 0.1, more preferably 0.002 to 0.05, and still more preferably 0.005 to 0.03 mol per mol of silver halide.

A DIR compound used in the present invention refers to a compound capable of releasing a development inhibitor or a precursor thereof upon reaction with an oxidation product of a color developing agent, and there is preferable used a DIR compound having a releasable development inhibitor or its precursor at the active point of a conventional coupler. In the invention, the development inhibitor or its precursor is preferably diffusible one, and diffusible DIR compounds, D-1 through D-55 are specifically preferred, as defined and exemplified in JP-A 4-114153. Exemplary examples of the diffusible DIR compound include those described in U.S. Pat. No. 3,227,554, 3,647,291, 3,933,500, 3,958,993, 4,234,678 and 4,419,886; JP-A 51-13239 and 57-56837; Research Disclosure (hereinafter, denoted as RD) 21228 (Dec., 1981).

In the present invention is preferably employed panchromatic-sensitized silver halide emulsions, which are sensitive to visible light including all of blue light, green light and red light. These emulsions can be obtained by blending blue-sensitive, green-sensitive and red-sensitive silver halide emulsions in a given proportions, or adding, to a single silver halide emulsion, blue-sensitizing, green-sensitizing and red-sensitizing dyes to allow the emulsion)s) to be sensitive all of blue light, green light and red light.

Silver halide grains used in the photographic material according to the present invention have specifically no limitation with respect to the silver halide composition of the interior of the grains. In cases of silver iodobromide grains are preferred those having core/shell structure. The iodide content of the core phase is preferably not less than 10 mol % and more preferably not less than 20 mol %. The iodide content of the outermost shell layer is preferably not more than 10 mol %, and more preferably not more than 5 mol %. The method for analysis of silver halide grains is referred to, for example, one described in JP-A 4-142531.

The silver halide emulsion used in the invention is preferably uniform in distribution of the iodide content among grains. When the average iodide content of each grain is measured, a relative standard deviation of measured values is preferably not more than 20%, more preferably not more than 15%, and still more preferably between 5 and 12%. Herein, the relative standard deviation is referred to a standard deviation of the iodide content of at least 100 grains, divided by the average iodide content times 100.

The silver halide emulsion used in the invention is preferably monodisperse. The monodisperse silver halide emulsion refers to one in which the weight of silver halide grains having grain sizes falling within ±20% of the average grain size account for at least 70%, preferably at least 80% and more preferably 90 to 100% of the total weight of silver halide. Herein, the average grain size d is defined as a grain size di at the time when the product of frequency ni of the grain having a size of di and $di^3$, $nixdi^3$ becomes maximum (significant figure is three digits and the least figure is rounded off). The grain size is a diameter of a circle with an area equivalent to the projected area of the grain. The grain size can be determined by projecting the grain with expansion of 10,000 to 50,000 times and measuring the grain diameter of the projected area (in which the number of measured grains is at random 100 or more).

Preferred highly monodisperse emulsion has the width of distribution, as defined below, of not more than 20%, and more preferably 5 to 15%:

(Standard deviation of grain size)/(Average grain size)×100=Width of distribution (%)

wherein the grain size can be measured according to the method described above, and the average grain size is an arithmetic average, as follow:

Average grain size=Σdini/Σni.

The average grain size of silver halide emulsion used in the invention is preferably 0.1 to 10.0 μm, more preferably 0.2 to 5.0 μm, and still more preferably 0.3 to 3.0 μm.

The silver halide emulsion preferably contained tabular grains having an average aspect ratio of not less than 3, and more preferably of 4 to 20. The average aspect ratio according to the invention can be determined by arithmetically averaging a ratio of the grain size (above-described equivalent circular diameter) to grain thickness of each emulsion grain, and the concrete definition and the measuring method are the same as disclosed in JP-A 63-106746, 63-316847 and 2-193138. Further, silver halide described above is preferably silver iodobromide.

Silver halide emulsions can be prepared using an emulsion preparing apparatus by the double jet method, in which the pAg, pH, temperature and stirring of the liquid phase during nucleation and growth of silver halide grains are controlled according to a given pattern, and the addition of halide(s) such as sodium chloride, potassium bromide and potassium iodide and silver nitrate is controlled. In the invention, substantially light-insensitive silver halide grains (preferably, fine grain emulsion having an average grain size of 0.01 to 0.2 μm) are effectively incorporated into a protective layer or an interlayer. The proportion of the light-insensitive silver halide is preferably 9 to 15%, based on the total silver coating weight o the photographic material. Herein, the expression "substantially light-insensitive" means sensitivity of not more than 1/50 of that of the lowest sensitive grains contained in a light sensitive emulsion layer.

To achieve broad exposure latitude in the invention, plural silver halide emulsions different in grain size or halide composition may be mixedly employed, in any ratio, in a single layer. With respect to silver halide grains different in grain size and mixedly employed is preferred a combination of silver halide grains having the largest average grain size of 0.2 to 2.0 μm and those having the least average grain size of 0.05 to 1.0 μm, and silver halide grains having the intermediate average grain size may be further mixed therewith. The ratio of the largest average grain size of silver halide grains to the least average grain size is preferably 1.5 to 40.

UV absorbents used in the present invention are preferred those described in JP-A 8-69087. The UV absorbent is incorporated preferably in an amount of 0.001 to 3 $g/m^2$, and more preferably 0.01 to 1.0 $g/m^2$. The UV absorbent may be incorporated into any one of photographic component layers, and preferably, for example, a layer nearest to the support or a light insensitive layer adjacent thereto, i.e. an anti-halation layer or a backing layer, or a layer farthest from the support and on the side nearer to light source or a light insensitive layer adjacent thereto. According to the invention, it is preferred that a UV absorbing light-insensitive layer, which is provided on the side farther from the support, has a transmission density at 370 nm of 1.0 to 2.0 in portions corresponding to the minimum density portion on a characteristic curve. In cases of being less than 1.0, lowering of contrast of the monochromatic image occurs, reducing prevention of UV rays produced by static during preparation of the photographic material and forming so-called static marks. In cases of being more than 2.0, on the other hand, when monochromatic negative images are printed on black-and-white print paper, exposure time is extended due to high absorbance, which is undesirable in terms of working property in the photofinishing lab. The UV absorbent may be incorporate into a photographic component layer as it is, if being liquid at ordinary temperature, or may be dissolved in a low boiling solvent such as ethyl acetate, dispersed in an aqueous solution of binder such as gelatin and incorporated into the layer.

The photographic material according to the invention preferably comprises at least two light sensitive layers, each of which contains plural couplers, that is, a yellow coupler, magenta coupler and a cyan coupler, and which are the same in color sensitivity and different in speed. Silver halide color photographic materials for use in general photography are comprised of at least two light sensitive layers which are the same in color sensitivity and different in speed, for the purpose of expanding exposure latitude to enhance photographing allowance. In the present invention was also achieved effects of enhancing the photographing allowance, and furthermore, according to the invention, a silver halide monochromatic photographic material which was superior in stability of color forming balance and color-developable, was accomplished. The photographic material according to the invention comprises more preferably at least three light sensitive layers, each of which contains plural couplers, and which are the same in color sensitivity and different in speed.

The present invention relates to a silver halide light sensitive monochromatic photographic material so that its color sensitivity, i.e. spectral sensitivity may basically correspond to the overall region of spectral luminous efficacy of human eye. Accordingly, as in conventional silver halide color photographic materials, it is not necessary to separate the light sensitive layer into three color sensitive layers and allow couplers different from each other to be contained in each of the layers, so that even if the light sensitive layer comprises two or more layers, any color sensitivity of each layer may correspond to overall (panchromatic) region of spectral luminous efficacy of human eye.

According to the invention, contribution of the low speed layer to density is preferably not less than 40%, and more preferably not less than 45%; contribution of the high speed layer to density is preferably not more than 25%, and more preferably not more than 20%. Sharing relationship between maximum densities of the low speed layer, medium speed layer and high speed layer can be measured according to exposure system described in JP-B 7-92597. The high speed layer and medium speed layer, and the medium speed layer and low speed layer respectively are preferably adjacent with each other. Each of the high speed layer, medium speed layer and low speed layer is optimized by taking account of contrast, graininess and sharpness; it is generally preferred that the high speed layer is higher in sensitivity by 0.1 to 1.0 of $|\log E|$(in which E is exposure) than that of the medium speed layer, and the medium speed layer is higher in sensitivity by 0.1 to 1.0 of $|\log E|$ than that of the low speed layer.

The monochromatic image forming photographic material according to the invention can achieve the object of the invention through conventional color process comprising the process of developing with a color developing solution after exposure. Preferred examples of the conventional color process include C-41 Process available from Eastman Kodak, CNK-4 Process available from Konica, and CN-16 Process available from Fuji Film.

In the invention, monochromatic images can be obtained by printing on black-and-white print paper or color paper from a color-processed monochromatic negative film according to the invention, and it is preferable to obtain a sepia-toned monochromatic image print by printing on color print paper. The sepia-toned color is, in general, lightly darkish yellow, which is described as 10YR 2.5/2 (color specification method by three attributes) in JIS Z 8721. It is also color belonging to yellow to yellowish red in JIS Z 8701 (color specification method by XYZ color system and X10Y10Z10 color system). These are described in "Shikisai Kagaku Jiten" (Handbook of Color Science, edited by Nihon Shikisai Gakkai). In "Iro no Namae Pocket-Zukan" (Kunio Fukuda, published by Shufunotomo), the sepia color is also represented by dot densities, C60, M74, Y85 and B57 in offset printing.

In the invention, sepia-toned color is defined as the region meeting the following requirements in L*a*b* specification system:

$$b^* \geqq a:,\ b \leqq 3.5a^*,\ 60 \leqq L^* \leqq 90, \text{ and } 5 \leqq c^*.$$

To obtain sepia-toned monochromatic print image by printing on color print paper, black-and-white images can be converted to sepia-toned images through operating, in printing, e.g. Y-button and C-button, Y-button and M-button, Y-button and M-button, and C-button.

Silver halides used in the invention are not limited and usable are those described in RD 308119 page 993, item I-A to page 995, item II. Silver halide emulsions which have been subjected to physical ripening, chemical ripening and spectral sensitization, are used. Additives used in these processes are described in RD17643, page 23, item III to page 24, item VI-M; RD18716, pages 648–649; and RD308119, page 996, item III-A to page 1000, item VI-M. Known photographic additives used in the invention are also described in RD17643, page 25, item VIII-A to page 27, item XIII; RD18716, pages 650–651; and RD308119, page 1003, item VIII-A to page 1012, item XXI-E. A variety of couplers are usable in the invention, and examples thereof are described in RD17643, page 25, item VII-C to G; RD308119, page 1001, item VII-C to G. The additives used in the invention can be incorporated through the dispersing method described in RD308119, page 1007 item XIV. In the invention are used supports described in RD17643, page 28 item XVII; RD18716, page 647–648; and RD308119 page 1009, item XVII. There may be provided, in the photographic material, an auxiliary layer such as a filter layer or interlayer, described in RD308119, page 1002, item VII-K.

The photographic material according to the invention may be provided with a magnetic recording layer for inputting various informations regarding the photographic material such as the kind, production number, name of maker and emulsion number; various informations regarding photographing such as the photographing date and time, exposure time, illuminating conditions, filter used, climate, photographing size, type of a camera and use of anamorphic lens; various informations necessary for printing such as the number of prints, selection of a filter, favorite color of a client and trimming size; and other informations regarding the client. The magnetic recording layer is preferably provided on the support opposite to photographic component layer(s), and a sublayer, antistatic layer (conductive layer), magnetic recording layer and lubricating layer are provided in this order from the support.

One embodiment of the invention is a photographing unit, in which an unexposed photographic material, specifically a monochromatic image forming photographic material is packaged in the state capable of being photographed, and the photographing unit itself need not vary from that used for a color film and techniques known in the art are applicable thereto. FIG. 1 shows an example of the photographing unit.

The photographic material according to the invention can be loaded in a single use camera. As a main body of the camera can be employed one described in JP-A 8-76216. Exemplary examples of the main body of the camera are shown in FIGS. 2 to 5, but are not limited to these. The main body of the camera is preferably one having a size of 107×54×26 mm, having a lens of f32 mm and F10, a lens-fitted finder and a shutter speed of 1/100; or one of 104×54×23 mm, having a lens of f30 mm and f9.5, a lens-fitted finder and a shutter speed of 1/100.

The single use camera is schematically illustrated in FIGS. 2 to 5. The single use camera 1 is comprised of camera body 2, front cover 3 and back cover 4, each of which is formed of resin. An unexposed photographic film is previously loaded in the camera body 2, the front cover 3 is attached to the front side of the camera body 2, and the back cover 4 is attached to the back side of the camera body 2. Thus, engaging protrusion 6 formed on the lower side of the camera body 2 is engaged with engaging hole formed on the lower side of back cover 4. Engaging hook 7 formed on the upper side of back cover 4 is engaged with engaging hole 8 formed on the lower side of back cover 3; engaging protrusion 10 formed on the lower side of front cover 3 is engaged with engaging hole 9 constituting an engaging concave formed on the lower side of back cover 4, and engaging hook 12 formed on the lower side of front cover 3 is engaged with another engaging hole 11.

Disassembling slot 13 for inserting a tool such as a screw driver is formed on the lower side of back cover 4. Convex portion 14 for building-in a photographing portion is formed in the center of front cover 3, finder window 15 is formed over convex portion 14, flash window 16 is formed in the vicinity of finder window 15, and flash selection switch 17 is provide thereunder. Release button 18 is further provided on the upper side of front cover 3.

Figure 5:
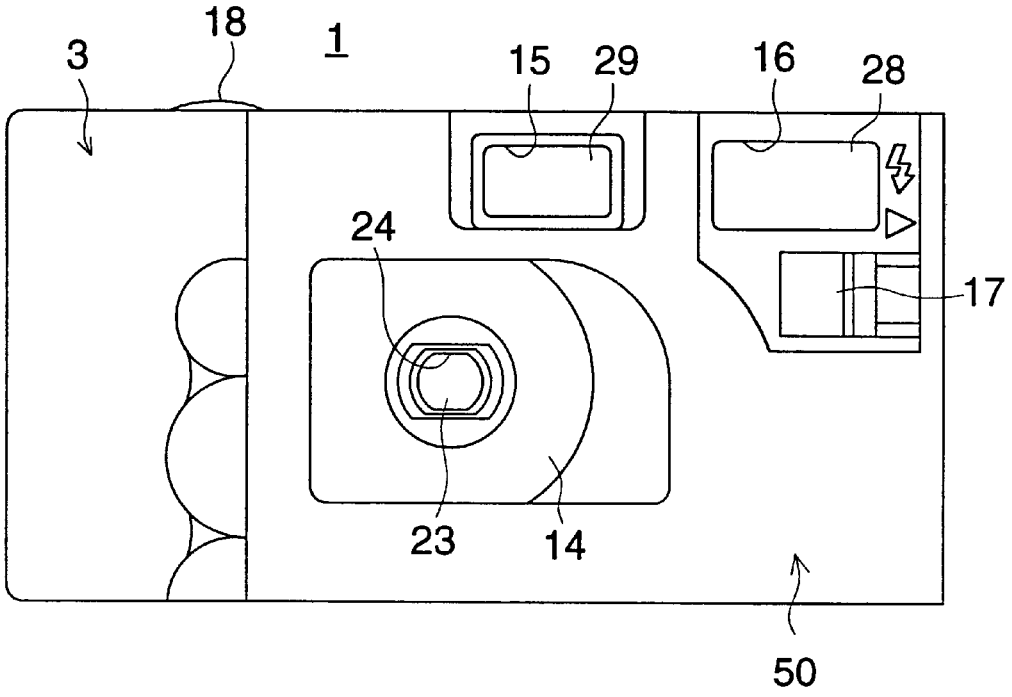
FIG. 5 is front view of a singlr use camera provided with paper cover.
Figure 6:
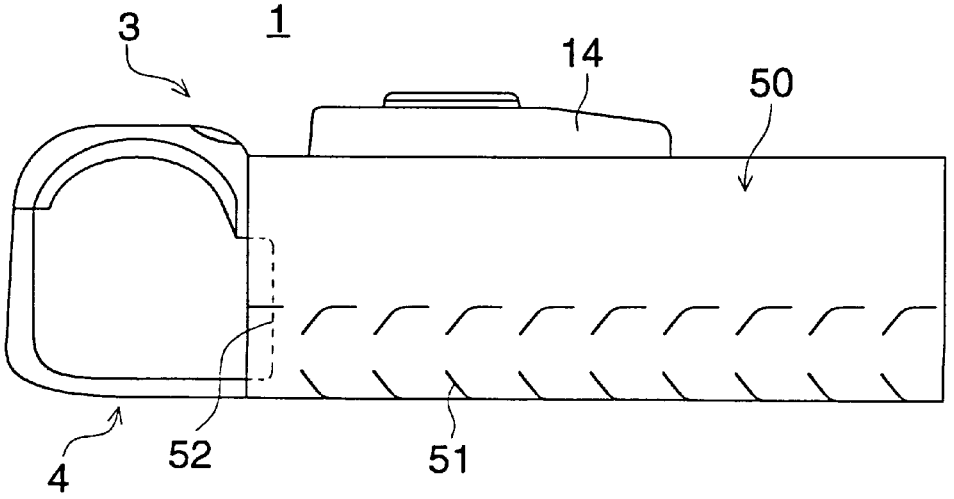
FIG. 6 is bottom view of a singlr use camera provided with paper cover.

Single use camera 1 is provided with a paper cover, as shown in FIGS. 5 and 6. FIG. 5 is a front view of a single use camera provided with the paper cover, and FIG. 6 is bottom view thereof. There is provided paper cover 50, covering front cover 3 and back cover 4; and paper cover 50, protecting front cover 3 and back cover 4 and explanation for proper use of the camera being described therein. Perforations 51 for easy separation in disassembling the camera is previously formed on paper cover 50, and on the bottom of back cover 3, opposite to the upstream of perforated line 51, is provided concave portion 52 to be put into the edge portion of paper cover 50. Thereby, it enables easy tearing off of perforations 51 by allowing fingertips to be put under concave portion 52 and pulling the edge of paper cover 50 with fingertips at the time of disassembing the camera. In FIG. 6. back cover 4 is provided with concave portion 52 being positioned under the edge of paper cover 50 and in the case when the upstream side perforations 51 are on positioned on front cover 3, the front cover 3, concave portion 52 to be put under the edge of paper cover 50 is formed.

EXAMPLES

The present invention is explained further in detail, based on examples but embodiments of the invention are not lomited to these examples. In the following, unless otherwise noted, the coating amount is represented by g/m$^2$, silver halide is represented by equivalent converted to silver and a sensitizing dye is represented by molar number per mol of silver halide contained in the same layer. In each of silver halideemulsions, a grain size is defined as a diameter of a circle having the area equivalent to the projected area of the grain, and an average grain size and average iodide content (mol %) are shown therein.

EXAMPLE 1

On a transparent, subbed triacetyl cellulose support with a thickness of 122 μm were coated layers having the composition as shown below, in this order from the support, to prepare a multi-layered monochromatic photographic material sample 101.

1st Layer: Antihalation layer

| | |
|---|---|
| Black colloidal silver | 0.16 |
| UV absorbent (UV-1) | 0.25 |
| High boiling organuc solvent (Oil-1) | 0.26 |
| High boiling organuc solvent (Oil-2) | 0.19 |
| High boiling organuc solvent (Oil-3) | 0.58 |
| Colored couplr (CM-1) | 0.26 |
| Colored couplr (CC-1) | 0.10 |
| Gelatin | 1.53 |

2nd Layer: Interlayer

| | |
|---|---|
| Gelatin | 0.80 |

3rd Layer: Low speed emulsion layer

| | |
|---|---|
| Silver iodobromide emulsion A (0.40 μm, 4 mol % iodide) | 0.98 |
| Sensitizing dye (SD-1) | $7.1 \times 10^{-5}$ |
| Sensitizing dye (SD-2) | $0.6 \times 10^{-5}$ |
| Sensitizing dye (SD-3) | $3.4 \times 10^{-5}$ |
| Sensitizing dye (SD-4) | $8.5 \times 10^{-4}$ |
| Sensitizing dye (SD-5) | $9.3 \times 10^{-5}$ |
| Yellow coupler (Y-1) | 0.31 |
| Magenta coupler (M-1) | 0.13 |
| Cyan coupler (C-1) | 0.28 |
| DIR compound (D-1) | 0.03 |
| Antistaining agent (AS-1) | 0.04 |
| High boiling organic solvent (Oil-3) | 0.72 |
| Gelatin | 2.10 |

4th Layer: Medium speed emulsion layer

| | |
|---|---|
| Silver iodobromide emulsion B (0.60 μm, 7 mol % iodide) | 1.50 |
| Sensitizing dye (SD-2) | $1.4 \times 10^{-5}$ |
| Sensitizing dye (SD-3) | $2.0 \times 10^{-5}$ |
| Sensitizing dye (SD-6) | $7.9 \times 10^{-5}$ |
| Sensitizing dye (SD-7) | $5.1 \times 10^{-5}$ |
| Sensitizing dye (SD-8) | $3.4 \times 10^{-5}$ |
| Sensitizing dye (SD-9) | $2.7 \times 10^{-4}$ |
| Yellow coupler (Y-1) | 0.23 |
| Magenta coupler (M-1) | 0.12 |
| Cyan coupler (C-1) | 0.24 |
| DIR compound (D-2) | 0.006 |
| Antistaining agent (AS-1) | 0.03 |
| High boiling organic solvent (Oil-3) | 0.55 |
| Gelatin | 2.20 |

5th Layer: High speed emulsion layer

| | |
|---|---|
| Silver iodobromide emulsion C (0.75 μm, 8 mol % iodide) | 1.50 |
| Sensitizing dye (SD-2) | $0.4 \times 10^{-5}$ |
| Sensitizing dye (SD-3) | $5.6 \times 10^{-5}$ |
| Sensitizing dye (SD-6) | $5.5 \times 10^{-5}$ |
| Sensitizing dye (SD-7) | $6.3 \times 10^{-5}$ |
| Sensitizing dye (SD-8) | $4.4 \times 10^{-5}$ |
| Sensitizing dye (SD-9) | $3.2 \times 10^{-4}$ |
| Yellow coupler (Y-1) | 0.12 |
| Magenta coupler (M-1) | 0.07 |
| Cyan coupler (C-1) | 0.13 |
| DIR compound (D-2) | 0.006 |
| Antistaining agent (AS-1) | 0.02 |

-continued

| | |
|---|---|
| High boiling organic solvent (Oil-3) | 0.33 |
| Gelatin | 1.60 |

6th Layer: First protective layer

| | |
|---|---|
| Silver iodobromide emulsion C (0.05 μm, 3 mol % iodide) | 0.30 |
| UV absorbent (UV-1) | 0.30 |
| Gelatin | 1.44 |

7th Layer: Second protective layer

| | |
|---|---|
| Alkaline-soluble matting agent PM-1 (average particle size 2 μm) | 0.15 |
| Poly (methyl methacrylate) (average particle size 3 μm) | 0.04 |
| Lubricant (WAX-1) | 0.02 |
| Gelatin | 0.55 |

In addition to the above composition were added coating aids SU-1, SU-2 and SU-3, dispersing aid SU-4, viscosity-adjusting agent V-1, stabilizer ST-1, dye AI-1, and AI-2, antifoggant AF-1 and AF-2 (two kinds of poly(vinyl pyrrolidone) with weight-averaged molecular weight of 10,000 and 100,000), hardening agent H-1 and H-2, and anti-septic agent DI-1.

Oill-1: Tricresyl phosphate

Oil-2: Dioctyl phthalate

Oil-3: Dibutyl phthalate

AS-1: 2-Butoxy-5-t-octyl-N,N-dibutylaniline

SU-1: Dioctyl sulfosuccinate sodium salt

SU-2: $C_8H_{17}SO_2N(C_3H_7)\ CH_2COOK$

SU-3: $C_8H_{17}SO_2NH(CH_2)_3N^+(CH_3)_3 \cdot Br^-$

SU-4: Sodium tri-i-propylnaphthalenesulfonate

St-1: 4-Hydroxy-6-methyl-1,3,3a,7-tetrazaindene

Af-1: 1-phenyl-5-mercaptotetrazole

H-1: 2,4-Dichloro-6-hydroxy-s-triazine sodium salt

Y-1

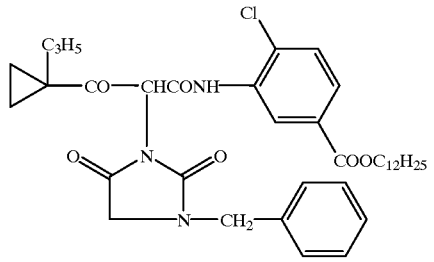

M-1

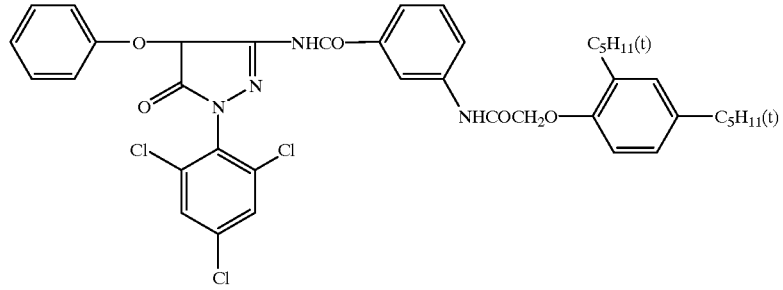

C-1

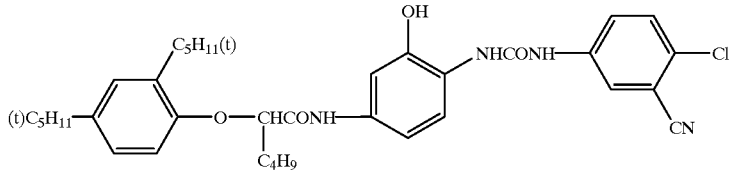

-continued
CM-1
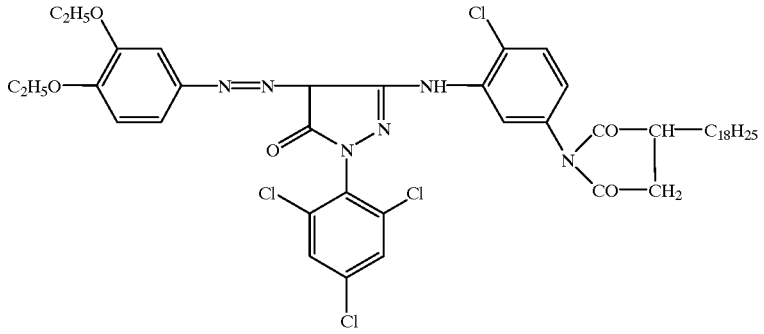
CC-1
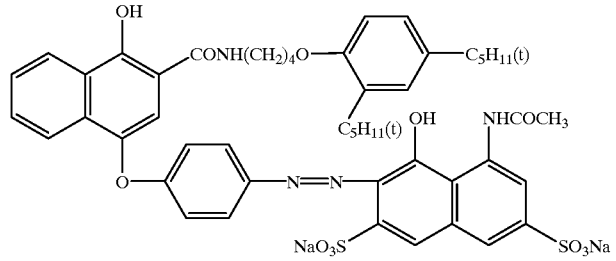
D-1
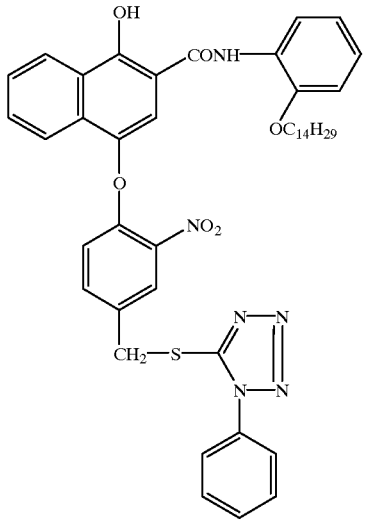
D-2
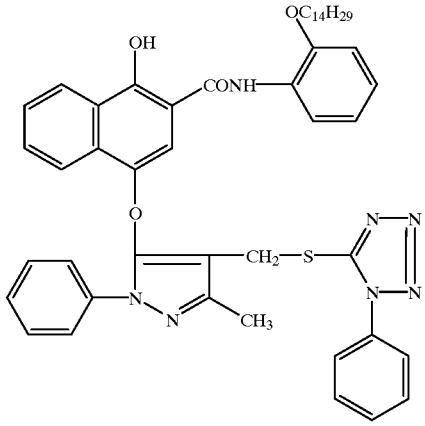

-continued
SD-1
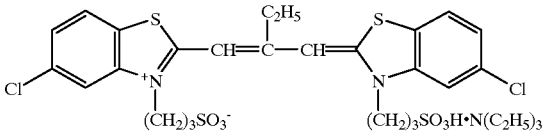
SD-2
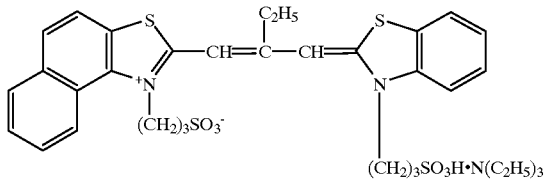
SD-3
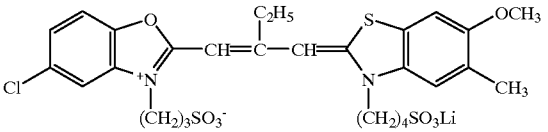
SD-4
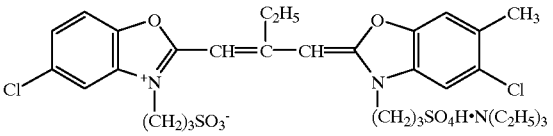
SD-5
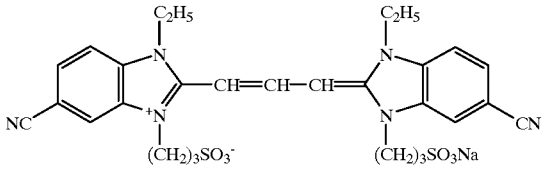
SD-6
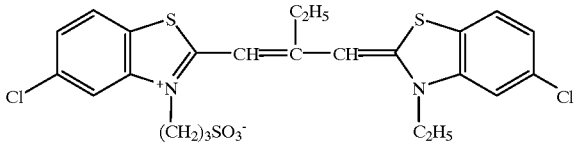
SD-7
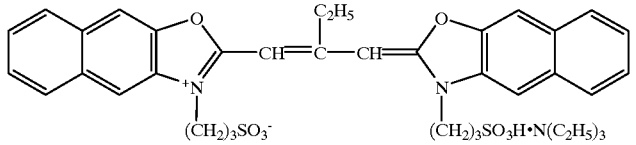
SD-8
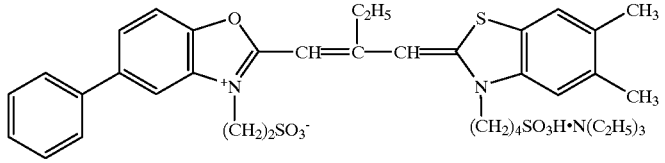
SD-9
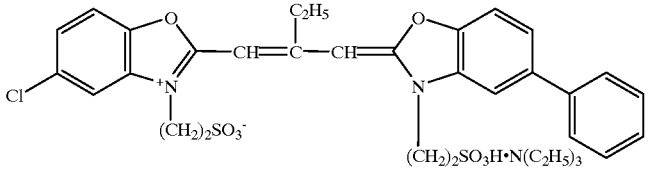

-continued
UV-1
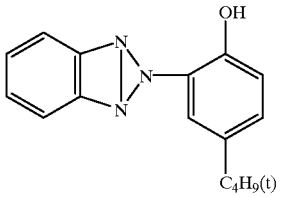
WAX-1
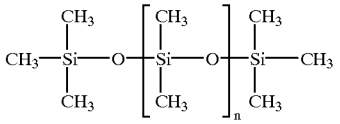
Weight-averaged molecular weight MW: 3,000
H-2
$[(CH_2{=}CHSO_2CH_2)_3CCH_2SO_2CH_2CH_2]_2NCH_2CH_2SO_3K$
PM-1
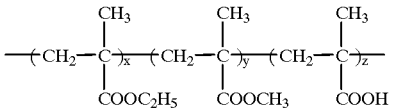
$x:y:z$ = 3:3:4
V-1
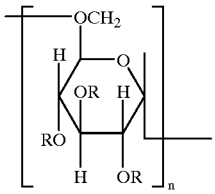
R:H, $SO_3H$
Average molecular weight MW: 120,000
DI-1 (Mixture of the following three components)
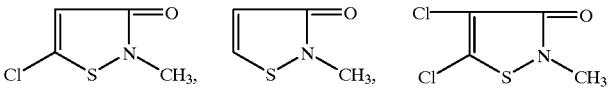
(Component A) (Component B) (Component C)
A:B:C: = 510:46:4 (mola ratio)
AI-1
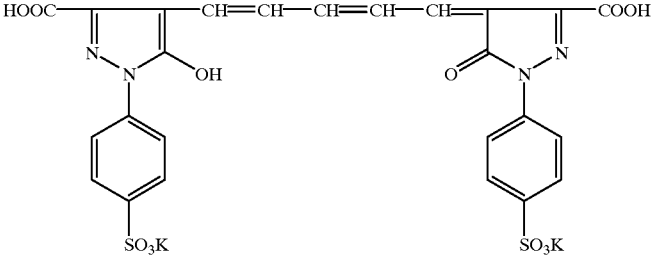

-continued

AI-2

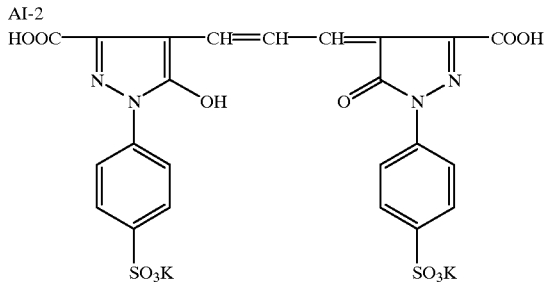

Using a combination of couplers as shown in Table 1 and optimally adjusting the coupler amounts, Samples 102 through 106 were prepared.

Using Samples 101 to 106 and by varying exposure from −4 in a steped manner, outdoor portrait photographing was performed and using Konica Mini-lab system NPS-858J-Type II (in which the printer portion was set to print level channel of Konica LV series), photographed samples were processed using process CNK-41-J1 for use in Konica color negative film and dried to obtain a film sample having monochromatic images. Stability of slope with respect to the neutral gray image density was evaluated from monochromatic prints obtained by printing on Konica color paper type QAA5. Sweating was also evaluated as follows.

Evaluation of sweating

Samples 101 to 106 were each conditioned at 55% RH., air-tightly wrapped, and after aging at 70° C. for 3 days, samples were subjected to color development processing according to the steps decribed below and then visually evaluated, based on the following criteria.

x: When held to the light, the sample looked muddy.

Δ: When held to the light, the sample looked slightly muddy.

○: No abnormality was observed on the surface or in the interior.

Resuts are shown in Table 1.

TABLE 1

| Sample No. | Coupler in 3rd, 4th and 5th layers | Rel. coupling rate Faster Slower | CRR-M/CRR-Y CRR-M/CRR-C | Slope stability with exposure variation (visual evaluation) | Sweating |
|---|---|---|---|---|---|
| 101 (Inv.) | Y-1 M-1 C-1 | M-1 > Y-1 > C-1 | 0.95 0.94 | Neutral gray tone was obtained in the region of low exposure to high exposure, brilliant black images were obtained. | ○ |
| 102 (Inv.) | Y-1 M-1 C-2 | M-2 > C-2 > Y-1 | 0.95 0.99 | Neutral gray tone was obtained in the region of low exposure to high exposure, brilliant black images were obtained. | ○ |
| 103 (Inv.) | Y-1 M-2 C-1 | M-2 > Y-1 > C-1 | 0.91 0.93 | Neutral gray tone was obtained in the region of low exposure to high exposure, brilliant black images were obtained. | ○ |
| 104 (Inv.) | Y-2 M-1 C-1 | M-1 > C-1 > Y-2 | 0.62 0.94 | Slightly yellowish-toned images were obtained in the region of medium exposure to high exposure. | Δ |
| 105 (Inv.) | Y-1 M-1 C-3 | M-1 > Y-1 > C-3 | 0.95 0.57 | Slightly bluish-toned images were obtained in the region of medium exposure to high exposure. | Δ |
| 106 (Inv.) | Y-2 M-1 C-3 | M-1 > Y-2 > C-3 | 0.62 0.57 | Slightly reddish-toned images were obtained in the low density region. | Δ |
| 107 (Comp.) | Y-1 M-3 C-4 | C-4 > Y-1 > M-3 | 1.29 1.46 | Reddish images were obtained in the overall region. | × |

Y-2
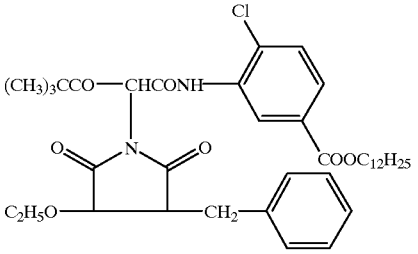
M-2
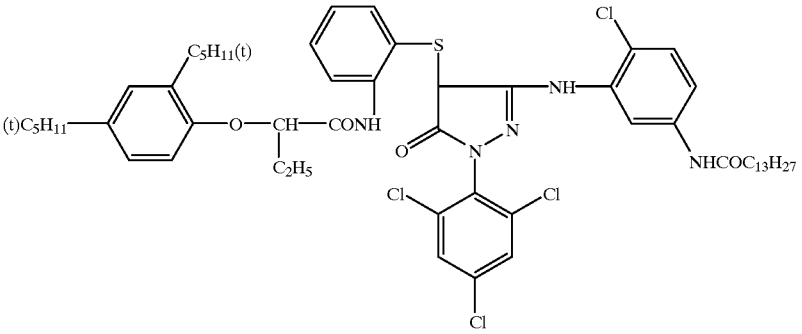
M-3
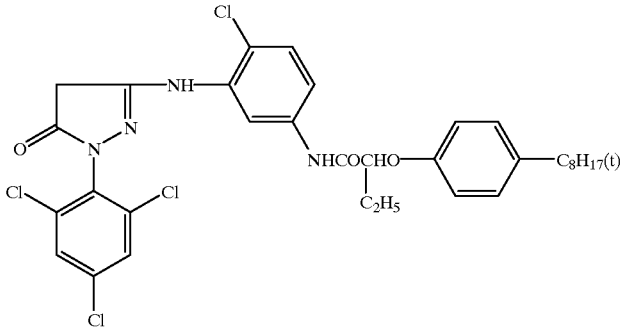
C-2
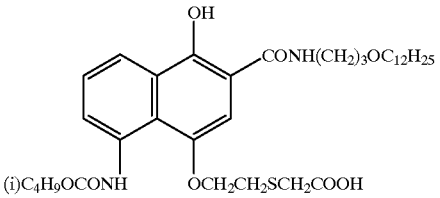
C-3
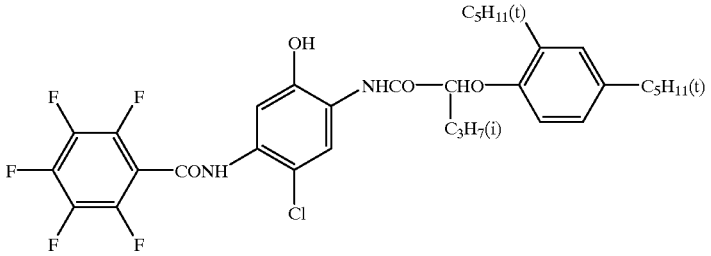

-continued

C-4

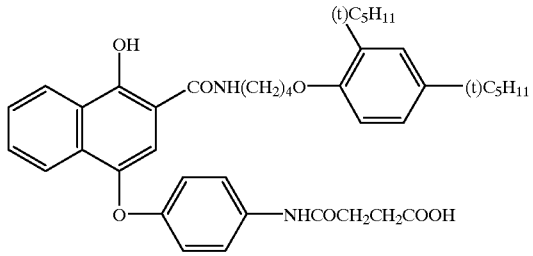

Next, in the process of printing work to make up sepia tone-finished prints by operating the printer-button was made a survey with respect to complexity of the operation and stability of the print finish. As a result, in comparative Sample 104, trial exposure was twice needed to adjust to the printing condition for sepia tone balance, and further slight adjustments were needed in some scenes. Contrarily, inventive Sample 101, achieved according to the same condition as in Konica color negative film LV series. Thus, it was proved to be suited to conventional negative-positive system color photographic process in a commercial processing facility and to be able to stably obtain sepia-toned monochromatic prints without adding any load onto the working process in a photofinishing laboratory.

Example 2

Samples 201 to 204 were prepared in a manner similar to Sample 101, provided that the coating amount of a coupler, the silver halide grain size or the extent of chemical sensitization was optimally adjusted so that the high speed, medium speed and low speed layers each had a share in density as shown in Table 2 and the contrast in standard color processing (3 min. 15 sec.) had linearity.

Samples were exposed through an optical wedge using 5400K light source and processed according to the process described below. Processed samples were evaluated as follows.

Evaluation of graininess

Graininess of a magenta image was evaluated, based on RMS granularity. RMS granularity was determined by scanning a density of fog plus 0.3 with a microdensitometer having an aperture scanning area of 1800 $\mu m^2$ (slit width of 10 $\mu$m, slit length of 180 $\mu$m) and calculating a 1,000 times value of a standard deviation of variation in density of the sampling number of 1,000 or more, and represented as a relative value, based on that of Sample 101 being 100. The less the value, the better graininess.

Evaluation of sharpness

Samples were exposed through a pattern used for MTF measurement and a MTF value at 25 cycles/mm was determined. Results are shown in Table 2

TABLE 2

| Sample No. | Density share of low speed layer (%) | Density share of high speed layer (%) | Graininess | Sharpness |
|---|---|---|---|---|
| 101 (Inv.) | 45 | 20 | 100 | 0.85 |
| 201 (Inv.) | 40 | 25 | 105 | 0.82 |
| 202 (Inv.) | 50 | 20 | 95 | 0.94 |
| 203 (Comp.) | 30 | 20 | 120 | 0.58 |
| 204 (Comp.) | 35 | 35 | 150 | 0.62 |

Furthermore, silver image forming black-and-white photographic material, Konicapan 400 was subjected to standard development in Konicadol DP and measured with respect to graininess and sharpness. As a result, it was proved that inventive Samples 101, 201 and 202 were superior in graininess and sharpness to Konicapan 400, and comparative Samples 203 and 204 were inferior to Konicapan 400.

Processing

| Step | Time | Temperature | Repl.* |
|---|---|---|---|
| Color developing | 3 min. 15 sec. | 38 ± 0.3° C. | 780 cc |
| Bleaching | 45 sec. | 38 ± 2.0° C. | 150 cc |
| Fixing | 1 min. 30 sec. | 38 ± 2.0° C. | 830 cc |
| Stabilizing | 60 sec. | 38 ± 5.0° C. | 830 cc |
| Drying | 1 min. | 55 ± 5.0° C. | |

*Repl.: Replenishing amount per $m^2$ of photographic material

There were employed the following color developer solution, bleach solution, fixer solution, stabilizer solution, and replenisher solutions thereof.

Color developer and replenisher solutions

| | Developer | Replenisher |
|---|---|---|
| Water | 800 cc | 800 cc |
| Potassium carbonate | 30 g | 35 g |
| Sodium hydrogencarbonate | 2.5 g | 3 g |
| Potassium sulfite | 3.0 g | 5 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-ethyl-N-(β-hydroxyethyl)aniline sulfate | 4.5 g | 6.3 g |
| Diethylenetriaminepentaacetic acid | 3.0 g | 3.0 g |
| Potassium hydroxide | 1.2 g | 2 g |

Water was added to make 1 liter, and the pH of developer and its replenisher was adjusted to 10.06 and 10.18, respectively, using potassium hydroxide or sulfuric acid.

Bleach and replenisher solutions

| | Bleach | Replenisher |
|---|---|---|
| Water | 700 cc | 700 cc |
| 1,3-Diaminopropanetetraacetic acid iron(III) ammonium salt | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter, and the pH of bleach and its replenisher was adjusted to 4.4 using ammonia water or glacial acetic acid.

Fixer and replenisher solutions

| | Fixer | Replenisher |
|---|---|---|
| Water | 800 cc | 800 cc |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

The pH of the fixer and its replenisher were adjusted to 6.2 and 6.5, respectively with ammonia water or glacial acetic acid, and then water was added to each to make 1 liter.

Stabilizer and replenisher solutions

| | |
|---|---|
| Water | 900 cc |
| p-Octylphenylpolyoxyethylene ether | 2.0 g |
| Dimethylol urea | 0.5 g |
| Hexamethlenetetramine | 0.2 g |
| 1,2-benzoisothiazoline-3-one | 0.1 g |
| Siloxane (UCC L-77) | 0.1 g |
| Ammonia water | 0.5 cc |

Water was added to make 1 liter, and the pH was adjusted to 8.5 using ammonia water or 50% sulfuric acid.

Example 3

Samples 301 to 307 were prepared in a manner similar to Sample 101, provided that amounts of DIR compounds D-1 and D-2 contained in the 3rd, 4th and 5th layers were varied as shown in Table 3.

TABLE 3

| | DIR compound ($g/m^2$) | | |
|---|---|---|---|
| Sample No. | 3rd layer (D-1) | 4th layer (D-2) | 5th layer (D-2) |
| 101 (Inv.) | 0.03 | 0.006 | 0.006 |
| 301 (Comp.) | 0.006 | 0.03 | 0.006 |
| 302 (Comp.) | 0.006 | 0.006 | 0.03 |
| 303 (Inv.) | 0.03 | 0.012 | 0.0 |
| 304 (Inv.) | 0.03 | 0.0 | 0.012 |
| 305 (Comp.) | 0.012 | 0.03 | 0.0 |
| 306 (Comp.) | 0.012 | 0.0 | 0.03 |
| 307 (Inv.) | 0.036 | 0.006 | 0.0 |

Samples 101, 301 to 307 were each exposed and processed in the same manner as in Example 2 to obtain monochromatic images. The pH of the developer was varied to 9.8 with a diluted sulfuric acid or to 10.4 with an aqueous potassium hydroxide solution. Using each of these developers, samples were similarly processed.

Each of monochromatic images obtained was represented in D-LogE coordinate system, a straight line with respect to points at the minimum density (Dmin)+0.1, Dmin+0.3, Dmin+0.7, Dmin+1.0 and Dmin+1.0 were determined by the least square method, and a standard deviation of the distance between each point and the straight line was determined. The less the standard deviation, the better linearity. These results are shown in Table 4.

TABLE 4

| | Standard deviation of linearity at a pH | | |
|---|---|---|---|
| Sample No. | 9.8 | 10.06 | 10.4 |
| 101 (Inv.) | 0.09 | 0.07 | 0.08 |
| 301 (Comp.) | 0.18 | 0.14 | 0.17 |
| 302 (Comp.) | 0.22 | 0.16 | 0.20 |
| 303 (Inv.) | 0.10 | 0.08 | 0.09 |
| 304 (Inv.) | 0.11 | 0.09 | 0.11 |
| 305 (Comp.) | 0.17 | 0.11 | 0.15 |
| 306 (Comp.) | 0.23 | 0.17 | 0.23 |
| 307 (Inv.) | 0.11 | 0.08 | 0.10 |

As can be seen from Table 4, the present invention is not only superior in linearity at the standard pH but also stable in pH variation.

Example 4

Samples 401 to 404 were prepared in a manner similar to Sample 101, provided that the amount of the UV absorbent in the 6th layer (first protective layer) was varied as shown in Table 4. Samples prepared were each evaluated with respect to the time for printing on black-and-white print paper and static mark, as follows.

Print time test on black-and-white paper

Samples 101 and 401 to 404 were each subjected to outdoor portrait photographing and processed according to the steps described above were performed. Printing was made through each of the processed samples on black-and-white paper, Gekko SUPER-VR3 (produced by Mitsubishi Seishi Co.), using an enlarger, Lucky 60M-C (produced by LUCKY Corp.) and at an gaperture of 8, and the exposing time was measured.

Evaluation of static mark

The protective layer side of Samples 101, and 401 to 404 were rubbed 20 times with a rubber roller positioned in the vicinity of ±0 in triboelectric series to cause static discharge light. Then, samples were processed and evaluated with respect to occurrence of static mark, based on the following criteria.

A: No occurrence of static mark was observed.

B: Occurrence of static mark was slightly observed.

C: Occurrence of static mark was markedly observed.

TABLE 5

| Sample No. | UV absorbent | Absorbing density at 370 nm | Print time (sec.) | Occurrence of static mark |
|---|---|---|---|---|
| 101 (Inv.) | UV-1 | 1.5 | 11 | A |
| 401 (Inv.) | UV-1 | 1.0 | 11 | A |
| 402 (Comp.) | UV-1 | 0.8 | 10 | B |
| 403 (Comp.) | UV-1 | 0.5 | 10 | C |
| 404 (Comp.) | UV-1 | 2.5 | 22 | A |

Konicapan 400 was also subjected to outdoor portrait photographing and standard processing in Konicadol DP. As a result, the print time was 6 sec. Accordingly, although the print time is slightly extended, inventive samples were proved to be superior in resistance to static mark, being provided with function for the system of printing on a conventional color paper and further having suitability to black-and-white paper.

Example 5

On a transparent, subbed triacetyl cellulose support with a thickness of 122 μm were coated layers having the composition as shown below, in this order from the support, to prepare a multi-layered monochromatic photographic material sample 501.

1st Layer: Antihalation layer

| | |
|---|---|
| Black colloidal silver | 0.16 |
| UV absorbent (UV-1) | 0.21 |
| High boiling organuc solvent (Oil-1) | 0.12 |
| Colored couplr (CM-1) | 0.20 |
| Colored couplr (CC-1) | 0.04 |
| Gelatin | 1.53 |

2nd Layer: Interlayer

| | |
|---|---|
| Gelatin | 0.80 |

3rd Layer: Low speed emulsion layer

| | |
|---|---|
| Silver iodobromide emulsion A (0.40 μm, 4 mol % iodide) | 0.98 |
| Sensitizing dye (SD-1) | $2.4 \times 10^{-4}$ |
| Sensitizing dye (SD-2) | $2.1 \times 10^{-4}$ |
| Sensitizing dye (SD-3) | $1.9 \times 10^{-4}$ |
| Sensitizing dye (SD-4) | $1.7 \times 10^{-4}$ |
| Yellow coupler (Y-1) | 0.26 |
| Magenta coupler (M-1) | 0.21 |
| Cyan coupler (C-1) | 0.32 |
| High boiling organic solvent (Oil-2) | 0.72 |
| Gelatin | 2.10 |

4th Layer: Medium speed emulsion layer

| | |
|---|---|
| Silver iodobromide emulsion B (0.60 μm, 7 mol % iodide) | 1.50 |
| Sensitizing dye (SD-1) | $2.3 \times 10^{-4}$ |
| Sensitizing dye (SD-2) | $1.3 \times 10^{-4}$ |
| Sensitizing dye (SD-3) | $1.6 \times 10^{-4}$ |
| Sensitizing dye (SD-4) | $1.3 \times 10^{-4}$ |
| Yellow coupler (Y-1) | 0.20 |
| Magenta coupler (M-1) | 0.16 |
| Cyan coupler (C-1) | 0.24 |
| High boiling organic solvent (Oil-2) | 0.55 |
| Gelatin | 2.20 |

5th Layer: High speed emulsion layer

| | |
|---|---|
| Silver iodobromide emulsion C (0.75 μm, 8 mol % iodide) | 1.55 |
| Sensitizing dye (SD-1) | $1.8 \times 10^{-4}$ |
| Sensitizing dye (SD-2) | $1.0 \times 10^{-4}$ |
| Sensitizing dye (SD-3) | $1.3 \times 10^{-4}$ |
| Sensitizing dye (SD-4) | $1.0 \times 10^{-4}$ |
| Yellow coupler (Y-1) | 0.12 |
| Magenta coupler (M-1) | 0.08 |
| Cyan coupler (C-1) | 0.16 |
| High boiling organic solvent (Oil-2) | 0.33 |
| Gelatin | 1.60 |

6th Layer: First protective layer

| | |
|---|---|
| Silver iodobromide emulsion C (0.05 μm, 3 mol % iodide) | 0.30 |
| UV absorbent (UV-1) | 0.09 |
| UV absorbent (UV-2) | 0.10 |
| High boiling solvent (Oil-1) | 0.10 |
| Gelatin | 1.44 |

7th Layer: Second protective layer

| | |
|---|---|
| Alkaline-soluble matting agent PM-1 (average particle size 2 μm) | 0.15 |
| Poly (methyl methacrylate) (average particle size 3 μm) | 0.04 |
| Lubricant (WAX-1) | 0.02 |
| Gelatin | 0.55 |

In addition to the above composition were added coating aids SU-1, SU-2 and SU-3, dispersing aid SU-4, viscosity-adjusting agent V-1, stabilizer ST-1, dye AI-1, and AI-2, antifoggant AF-1 and AF-2 (two kinds of poly(vinyl pyrrolidone) with weight-averaged molecular weight of 10,000 and 100,000), hardening agent H-1 and H-2, and anti-septic agent DI-1. Oil-1 and Oil-2 were dioctyl phthalate and dibutyl phthalate, respectively.

Y-1
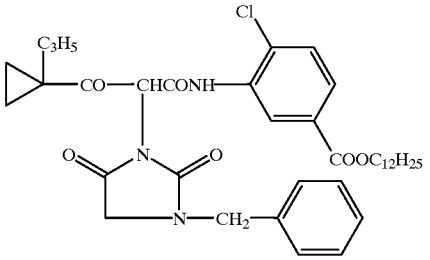
M-1
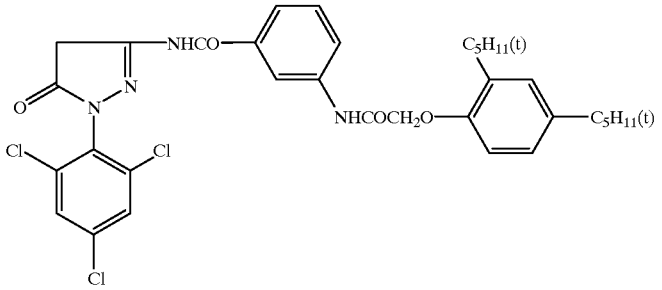
C-1
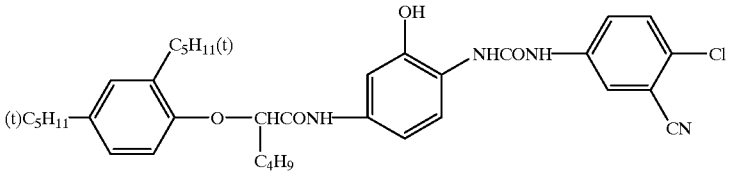
CM-1
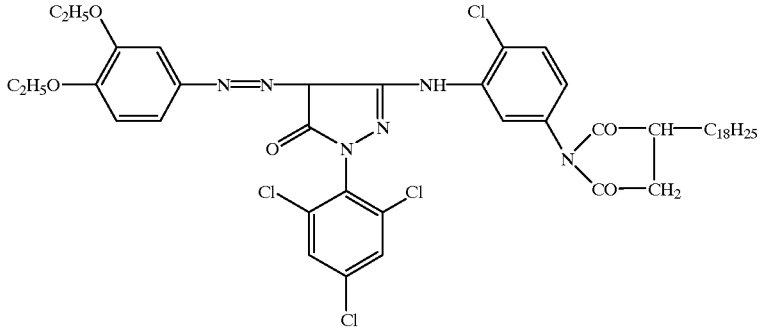
CC-1
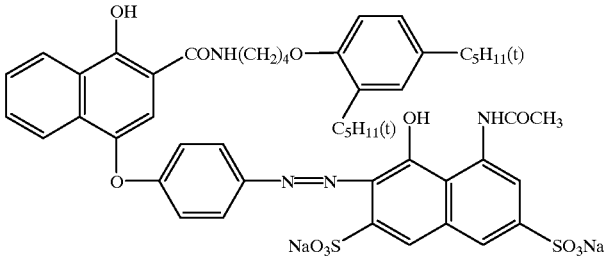
SD-1
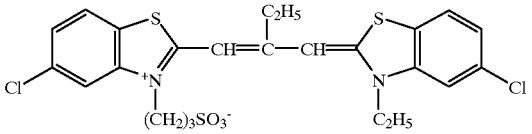

-continued
SD-2
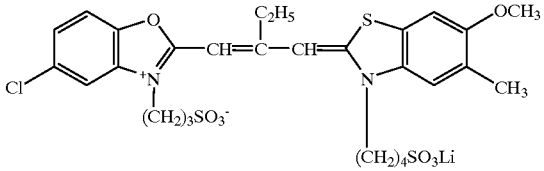
SD-3
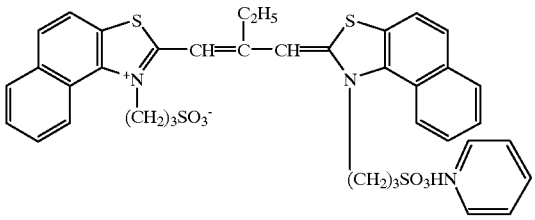
SD-4
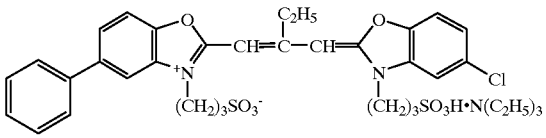
ST-1
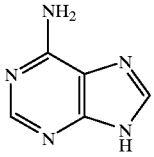
UV-1
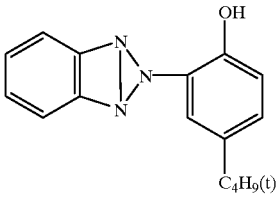
UV-2
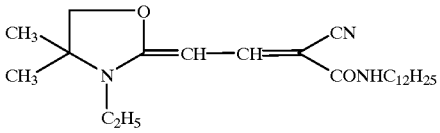
WAX-1
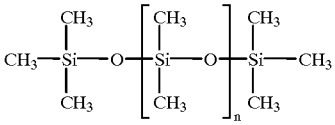
Weight-averaged molecular weight MW: 3,000
SU-1
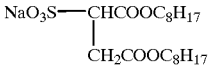
SU-2
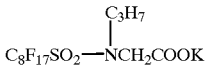
SU-3
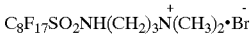

-continued
SU-4
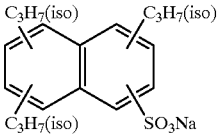
H-1
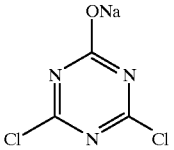
H-2
$[(CH_2{=}CH{-}SO_2CH_2)_3{-}C{-}CH_2{-}SO_2CH_2CH_2]_2{-}NCH_2CH_2SO_3K$
PM-1
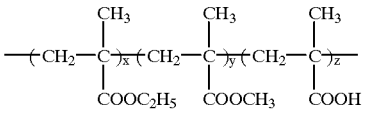
$x:y:z$ = 3:3:4
V-1
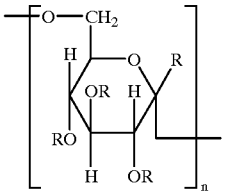
R:H, $SO_3H$
Average molecular weight Mw: 120,000
AF-1
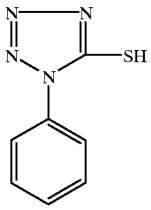
AF-2
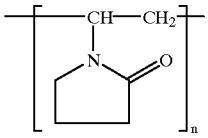
$n$: Polymerization degree
DI-1 (Mixture of the following components)
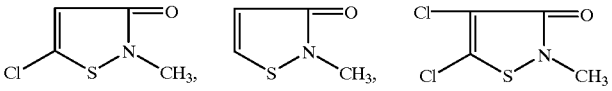
A B C
A:B:C: = 50:46:4 (molar ratio)

-continued

AI-1

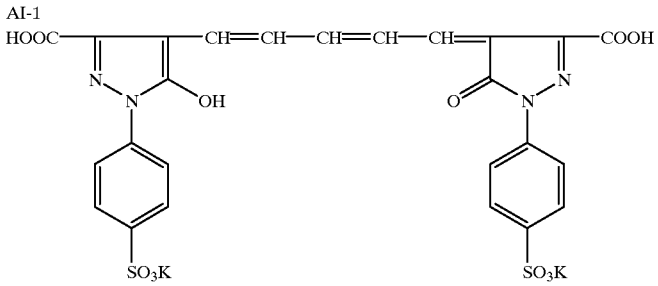

AI-2

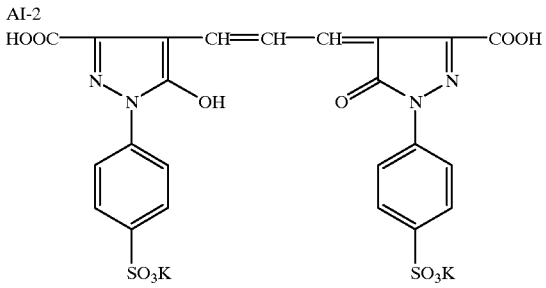

Samples 502 to 530 were prepared in the same manner as Sample 501, except that yellow coupler (Y-1), magenta coupler (M-1) or cyan coupler (C-1) was replaced by an equimolar amount of a coupler as shown in the following Table.

TABLE 6

| Sample No. | Yellow coupler | Magenta coupler | Cyan coupler | CRR-M/CRR-Y | CRR-M/CRR-C |
|---|---|---|---|---|---|
| 501 | Y-1 | M-1 | C-1 | 0.62 | 0.91 |
| 502 | 1 Y-2 | M-1 | C-1 | 0.95 | 0.91 |
| 503 | Y-1 | 2 M-2 | C-1 | 0.61 | 0.90 |
| 504 | Y-1 | M-1 | 3 C-3 | 0.62 | 0.99 |
| 505 | Y-1 | 4 M-2 | C-1 | 0.60 | 0.89 |
| 506 | 1 Y-2 | 2 M-2 | 3 C-3 | 0.93 | 0.97 |
| 507 | 1 Y-3 | 2 M-2 | 3 C-3 | 0.92 | 0.97 |
| 598 | 1 Y-4 | 2 M-2 | 3 C-3 | 0.92 | 0.97 |
| 509 | 1 Y-6 | 2 M-4 | 3 C-3 | 0.93 | 0.96 |
| 510 | 1 Y-6 | 4 M-2 | 3 C-3 | 0.92 | 0.96 |
| 511 | 5 Y-3 | 2 M-4 | 3 C-4 | 0.60 | 0.91 |
| 512 | 1 Y-2 | 6 M-9 | 3 C-3 | 0.91 | 0.95 |
| 513 | 1 Y-3 | 2 M-4 | 7 C-7 | 0.93 | 0.90 |
| 514 | 5 Y-3 | 6 M-9 | 7 C-1 | 0.60 | 0.93 |
| 515 | 5 Y-3 | 6 M-8 | 7 C-1 | 0.61 | 0.92 |
| 516 | 5 Y-4 | 6 M-9 | 7 C-1 | 0.60 | 0.93 |
| 517 | 5 Y-1 | 6 M-9 | 7 C-1 | 0.61 | 0.93 |
| 518 | 5 Y-3 | M-1 | C-1 | 0.63 | 0.91 |
| 519 | 1 Y-2 | 6 M-9 | 3 C-5 | 0.91 | 0.88 |
| 520 | 1 Y-2 | 4 M-2 | 7 C-7 | 0.92 | 0.89 |
| 521 | Y-1 | 6 M-9 | 7 C-7 | 0.59 | 0.86 |
| 522 | 1 Y-2 | 4 M-6 | 3 C-3 | 0.91 | 0.95 |
| 523 | 5 Y-3 | 4 M-6 | 7 C-1 | 0.59 | 0.93 |
| 524 | 5 Y-4 | 4 M-2 | 3 C-4 | 0.61 | 0.90 |
| 525 | 5 Y-3 | M-1 | 7 C-7 | 0.63 | 0.90 |
| 526 | 5 Y-3 | 2 M-2 | 7 C-1 | 0.60 | 0.93 |
| 527 | 5 Y-3 | 6 M-8 | 3 C-3 | 0.61 | 0.94 |
| 528 | 5 Y-3 | M-1 | 3 C-3 | 0.63 | 0.99 |
| 529 | 5 Y-3 | M-1 | 7 C-1 | 0.63 | 0.94 |
| 530 | Y-1 | M-1 | 7 C-1 | 0.62 | 0.94 |

Samples 501 to 530 were exposed through a wedge used for sensitometry and processed according to the process as in Example 2. The transmission density of each of processed Samples 501 to 530 was measured with amber light to determine a D-logE curve of monotone images. An intermediate density point, which corresponds to an arithmetic average of the maximum and minimum densities of each sample, (which is denoted as normal exposure-point), was defined as standard, and difference in hue was determined with respect to a density point corresponding to 10 times the exposure of the normal exposure-point (which is denoted as overexposure-point) and a point corresponding to 1/10 of the exposure of the normal point (which is denoted as underexposure-point). The hue difference, which is denoted as Z, is an absolute value of the distance between a point of $a_x^*b_y^*$ represented in terms of CIE1976 (L*a*b*) chromaticity coordinate and a point of $a_0^*b_0^*$ at the standard exposure (normal exposure-point), and Z meets the following relationship:

$$Z=[(a_x^*-a_0^*)^2+(b_y^*-b_0^*)^2]^{1/2}$$

The lower the values at the underexposure-point or the overexposure-point, the less the hue difference, indicating that deviation in color tone from the normal exposure-point as standard is less, and that preferable monotone images having a uniform color-balance in the photographable range from the highlight portion to the shadow portion are formed. Results thereof are shown in Table 7.

TABLE 7

| Sample No. | Hue difference at underexposure | Hue difference at overexposure | Sweating |
|---|---|---|---|
| 501 | 0.8 | 0.7 | Δ |
| 502 | 0.7 | 0.8 | ○ |
| 503 | 0.8 | 0.8 | Δ |
| 504 | 0.5 | 0.5 | Δ |
| 505 | 0.8 | 0.7 | Δ |
| 506 | 0.1 | 0.1 | ○ |
| 507 | 0.1 | 0.2 | ○ |
| 508 | 0.2 | 0.1 | ○ |
| 509 | 0.2 | 0.2 | ○ |
| 510 | 0.1 | 0.1 | ○ |
| 511 | 0.7 | 0.6 | Δ |
| 512 | 0.5 | 0.4 | ○ |
| 513 | 0.6 | 0.5 | ○ |
| 514 | 0.2 | 0.1 | ○ |
| 515 | 0.2 | 0.2 | ○ |
| 516 | 0.3 | 0.1 | ○ |
| 517 | 0.2 | 0.2 | ○ |

TABLE 7-continued

| Sample No. | Hue difference at underexposure | Hue difference at overexposure | Sweating |
|---|---|---|---|
| 518 | 0.7 | 0.5 | Δ |
| 519 | 0.6 | 0.5 | ○ |
| 520 | 0.6 | 0.5 | ○ |
| 521 | 0.5 | 0.6 | Δ |
| 522 | 0.3 | 0.2 | ○ |
| 523 | 0.4 | 0.5 | Δ |
| 524 | 0.7 | 0.5 | Δ |
| 525 | 0.6 | 0.6 | Δ |
| 526 | 0.6 | 0.3 | Δ |
| 527 | 0.4 | 0.5 | Δ |
| 528 | 0.5 | 0.4 | Δ |
| 529 | 0.5 | 0.5 | Δ |
| 530 | 0.7 | 0.4 | Δ |

As can be seen from Table 7, samples satisfying as a preferable embodiment of the present invention, the combination of couplers represented by formulas (1), (2) and (3), the combination of couplers represented by formulas (1), (4) and (3), or the combination of couplers represented by formulas (5), (6) and (7), were superior in stability of color balance, as compared to other samples. With regard to the slope stability with exposure variation, Samples 502, 506 to 510, 512, 513, 519, 520 and 522, which met the following requirements, provided brilliant black images in the overall region of from low exposure to high exposure:

$$0.8<\text{CRR-M/CRR-Y}<1.0$$

$$0.8<\text{CRR-M/CRR-C}<1.0.$$

Next, using Samples 501 to 530, outdoor portrait photographing was performed, and using Konica Mini-lab system NPS-858J-Type II (in which the printer portion was set to print level channel of Konica LV series), photographed samples were processed in process CNK-41-J1 for use in Konica color negative film and dried to obtain film samples of monochromatic images, 501 to 530. Further, by printing each of them on Konica color paper type QAA5, monochromatic prints were obtained.

In the process of printing to produce sepia-tone finished prints by selecting chices with the printer-button, a survey was done with respect to the complexity of the operation and stability of the print finish. As can be seen from Table 7, in samples as a preferable embodiment of the present invention, which satisfy the combination of couplers represented by formulas (1), (2) and (3), the combination of couplers represented by formulas (1), (4) and (3), or the combination of couplers represented by formulas (5), (6) and (7), only one trial exposure was needed to adjust the printing condition for sepia-tone balance; contrarily, in other samples, sepia-toned color of the highlight portion was different from that of the shadow portion, so that several trial exposures were needed. Thus, the present invention was proved to be suitable to conventional negative-positive system color photographic process in a commercial processing facility and to be able to stably obtain sepia-tone monochromatic prints without adding anything to the work load in a photofinishing laboratory.

As shown in the Examples afore-described, the silver halide photographic material according to the invention, i.e., monochromatic image-forming silver halide photographic material is suited for color photographic process of conventional negative-positive system, exhibiting superior effects such as superior color forming stability and easy printing on print paper.

What is claimed is:

1. A silver halide photographic light sensitive material comprising a transparent support and provided thereon a light sensitive layer containing a yellow coupler, a magenta coupler and a cyan coupler to form a monochromatic image upon color development after exposure, wherein a relative rate of coupling of the magenta coupler with an oxidation product of a color developing agent is greater than that of the yellow or cyan coupler;

said yellow coupler, said magenta coupler and said cyan coupler being represented by the following formulas (1), (2) and (3), respectively:

formula (1)

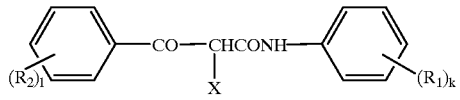

wherein $R_1$ and $R_2$ each represent a hydrogen atom or a substituent; k and l each represent an integer of 1 to 5, provided that when k or l is 2 or more, plural $R_1$s or plural $R_2$s may be the same with or different from each other; and X represents a group capable of being released upon coupling with an oxidation product of an aromatic primary amine color developing agent, formula (2)

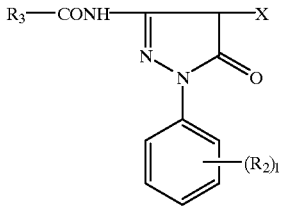

wherein $R_3$ represents a substituent; $R_2$ and l each are the same as defined in formula (1), provided that when l is 2 or more, plural $R_2$s may be the same with or different from each other; and X represents the same as defined in formula (1), provided that the group is bonded, through a nitrogen atom, to the 4-position of a pyrazolone ring, formula (3)

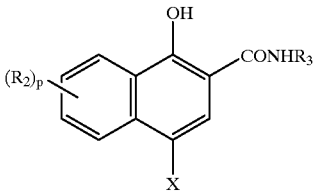

wherein $R_2$ and $R_3$ are the same as defined in formula (2), p represents an integer of 1 to 4, provided that when p is 2 or more, plural $R_2$s may be the same with or different from each other, and X is a hydrogen atom or the same as defined in formula (1).

2. The silver halide photographic material of claim 1, wherein the relative coupling rate of the yellow, magenta or cyan coupler is defined in term of the following CRR value, said CRR value of the magenta coupler being less than that of the yellow or cyan coupler:

$$CRR=(Do)_{max}/(Dc)_{max}$$

wherein $(Do)_{max}$ represents a maximum density obtained when a photographic material sample that contains singly the yellow, magenta or cyan coupler is subjected to exposure and color development in a developing solution, and $(Dc)_{max}$ represents a maximum density obtained when the photographic material sample is subjected to exposure and development in the developing solution that further contains citrazinic acid of 1.5 g/l.

3. The silver halide photographic material of claim 2, wherein a CRR value of the magenta coupler (CRR-M), that of the yellow coupler (CRR-Y) and that of the cyan coupler (CRR-C) satisfy the following relationship, $$0.8<\text{CRR-M}/\text{CRR-Y}<1.0$$

$$0.8<\text{CRR-M}/\text{CRR-C}<1.0.$$

4. The silver halide photographic material of claim 1, wherein said yellow coupler, said magenta coupler and said cyan coupler each are a two-equivalent coupler.

5. The silver halide photographic material of claim 1, wherein said light sensitive layer comprises at least two light sensitive sublayers, said two sublayers each containing the couplers as claimed in claim 1 and having the same spectral sensitivity.

6. The silver halide photographic material of claim 1, wherein said light sensitive layer comprises a high-speed light sensitive sublayer, a medium-speed light sensitive sublayer and a low-speed light sensitive sublayer, which are the same in spectral sensitivity and different in speed; said sublayers each containing the couplers as claimed in claim 1 and said low-speed sublayer containing couplers in an amount that gives a density of not less than 40% of the maximum density of the photographic material developed.

7. The silver halide photographic material of claim 1, wherein said light sensitive layer further contains a DIR compound, the photographic material further comprising a UV-absorbing light-insensitive layer provided farther from the support than said light sensitive layer, and said UV-absorbing layer having a transmission density at a wavelength of 370 nm of 1.0 to 2.0 in a minimum density portion.

8. The silver halide photographic material of claim 1, wherein said light sensitive layer comprises a high-speed light sensitive sublayer, a medium-speed light sensitive sublayer and a low-speed light sensitive sublayer, which are the same in spectral sensitivity and different in speed; said high-speed, medium-speed and low-speed sublayers each containing the couplers as claimed in claim 1 and further containing a DIR compound, a molar content of the DIR compound of said low-speed sublayer being larger than that of said high-speed sublayer or medium-speed sublayer.

9. The silver halide photographic material claim 1, wherein said light sensitive layer contains a colored coupler.

10. The silver halide photographic material of claim 1, wherein said photographic material is a negative film used in negative-positive process in which a negative image is printed on a color paper or a monochromatic paper to form a positive print image with a mono-color tone.

11. A silver halide photographic material wherein said yellow coupler, said magenta coupler and said cyan coupler are represented by the following formulas (5), (6) and (7), respectively,

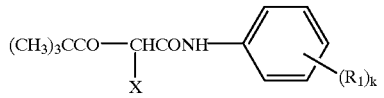

wherein $R_1$ represents a hydrogen atom or a substituent; k represents an integer of 1 to 5, provided that when k is 2 or more, plural $R_1$'s may be the same as or different from each other; and X is a group capable of being released upon coupling with an oxidation product of an aromatic primary amine color developing agent;

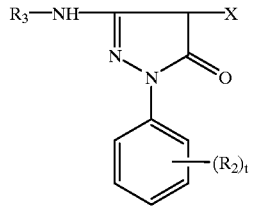

wherein $R_3$ represents a substituent; $R_2$ is hydrogen or a substituent and l is an integer of 1 to 5, provided that when l is 2 or more, plural $R_2$'s may be the same as or different from each other; and X is the group as defined in formula (5), provided that the group is bonded, through a sulfur atom, to the 4-position of a pyrazolone ring, formula (7)

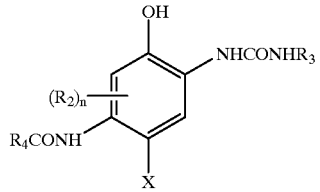

wherein $R_2$ and $R_3$ are the same as defined in formula (6); $R_4$ represents a substituent; n represents an integer of 1 or 2, provided that when n is 2, plural $R_2$'s may be the same as or different from each other; and X is a hydrogen atom or the same as defined in formula (5).

12. A silver halide photographic light-sensitive material comprising a transparent support and provided thereon a light-sensitive layer containing a yellow coupler, a magenta coupler and a cyan coupler to form a monochromatic image upon color development after exposure, wherein a relative rate of coupling of the magenta coupler with an oxidation product of a color developing agent is greater than that of the yellow or cyan coupler;

said yellow coupler, and said cyan coupler being represented by the following formulas (1) and (3), respectively; and said magenta coupler obtained by polymerization of a monomer represented by formula (4):

formula (1)

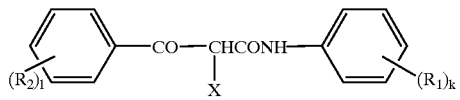

wherein $R_1$ and $R_2$ each represent a hydrogen atom or a substituent; k and l each represent an integer of 1 to 5, provided that when k or l is 2 or more, plural $R_1$'s or plural $R_2$'s may be the same with or different from each other; and X represents a group capable of being released upon coupling with an oxidation product of an aromatic primary amine color developing agent, formula (3)

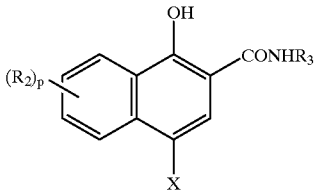

wherein $R_2$ and $R_3$ are the same as defined in formula (2), p represents an integer of 1 to 4, provided that when p is 2 or more, plural $R_2$'s may be the same or different from each other, and X is a hydrogen atom or the same as defined in formula (1), formula (4)

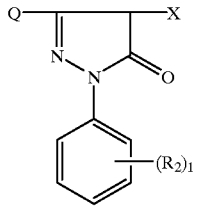

wherein $R_2$ and I are the same as defined in formula (1), provided that when I is 2 or more, plural $R_2$'s may be the same or different; X is as defined in formula (1); and Q represents a substituent having an ethylenic unsaturated double bond.

* * * * *